US009153910B2

(12) United States Patent
Aoki et al.

(10) Patent No.: US 9,153,910 B2
(45) Date of Patent: Oct. 6, 2015

(54) LEVER-TYPE CONNECTOR

(71) Applicant: Yazaki Corporation, Minato-ku, Tokyo (JP)

(72) Inventors: Hiroshi Aoki, Toyota (JP); Jun Kamiya, Toyota (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/377,568

(22) PCT Filed: Feb. 7, 2013

(86) PCT No.: PCT/JP2013/052899

§ 371 (c)(1),
(2) Date: Aug. 8, 2014

(87) PCT Pub. No.: WO2013/118830

PCT Pub. Date: Aug. 15, 2013

(65) Prior Publication Data

US 2015/0004829 A1 Jan. 1, 2015

(30) Foreign Application Priority Data

Feb. 8, 2012 (JP) ..... 2012-025348

(51) Int. Cl.
*H01R 13/62* (2006.01)
*H01R 13/629* (2006.01)

(52) U.S. Cl.
CPC ..... *H01R 13/62938* (2013.01); *H01R 13/629* (2013.01)

(58) Field of Classification Search
CPC ..... H01R 13/62938
USPC ..... 439/157
See application file for complete search history.

(56) References Cited

U.S. PATENT DOCUMENTS 6,190,187 B1 * 2/2001 Okabe et al. ..... 439/157
6,250,937 B1 * 6/2001 Okabe et al. ..... 439/157

(Continued)

FOREIGN PATENT DOCUMENTS

JP H0883645 A 3/1996
JP 2000-058193 A 2/2000

(Continued)

OTHER PUBLICATIONS

International Search Report issued in corresponding International Application No. PCT/JP2013/052899 mailed May 14, 2013.

(Continued)

*Primary Examiner* — Phuong Dinh
(74) *Attorney, Agent, or Firm* — Banner & Witcoff, Ltd.

(57) ABSTRACT

A fitting operation lever includes rotation fulcrum holes rotationally engaged with boss portions on a first connector housing, boss guiding grooves which enable an engagement or disengagement between the boss portions and the rotation fulcrum holes, and action point projecting portions which move from engagement starting positions on projecting portion guide grooves 25 inside a second connector housing 20 as the rotation of the fitting operation lever to be engaged with projection engagement projecting portions 27 within the second connector housing to thereby apply a force acting in a fitting direction to the second connector housing. The rotation fulcrum holes are formed into an elliptic shape which allows a contact positions thereof with the boss portions to move when the fitting operation lever is rotated in a returning direction when the connector housings are fitted together completely.

3 Claims, 20 Drawing Sheets

(56) References Cited

U.S. PATENT DOCUMENTS

| | | | | |
|---|---|---|---|---|
| 6,254,409 | B1 | 7/2001 | Okabe et al. | |
| 6,274,945 | B1 * | 8/2001 | Gilbreth et al. | 290/52 |
| 6,648,658 | B2 | 11/2003 | Okabe et al. | |
| 7,976,322 | B2 | 7/2011 | Matsumura et al. | |
| 2002/0142479 | A1 | 10/2002 | Okabe et al. | |
| 2009/0203240 | A1 | 8/2009 | Matsumura et al. | |
| 2009/0203241 | A1 * | 8/2009 | Matsumura et al. | 439/157 |

FOREIGN PATENT DOCUMENTS

| | | | |
|---|---|---|---|
| JP | 2002-298977 | A | 10/2002 |
| JP | 3442661 | B2 | 9/2003 |
| JP | 2009-187863 | A | 8/2009 |

OTHER PUBLICATIONS

May 14, 2013—Written Opinion—Int'l App PCT/JP2013/052899.

* cited by examiner

LEVER-TYPE CONNECTOR

CROSS REFERENCE TO RELATED APPLICATIONS

This is a U.S. National Phase Application under 35 U.S.C. §371 of International Application No. PCT/JP2013/052899, filed Feb. 7, 2013, which claims priority to Japanese Patent Application No. 2012-025348, filed Feb. 8, 2012, which were published Under PCT Article 21(2), the entire contents of which are incorporated herein by reference.

TECHNICAL FIELD

The present invention relates to a lever-type connector.

BACKGROUND ART

FIG. 23 shows a conventional example of lever-type connector.

This lever-type connector 100 is disclosed in Patent Document 1 below and includes a first connector housing 110, a second connector housing 120 in which the first connector housing 110 is fitted for connection, and a fitting operation lever 130 which is rotatably mounted on the first connector housing 110.

The second connector housing 120 has an outer cylindrical wall portion (a hood portion) 121 into which the first connector housing 110 is inserted.

The fitting operation lever 130 is rotatably mounted on boss portions 111 which are provided on outer surfaces of the first connector housing 110 so as to project therefrom as a lever member which reduces operation forces to be exerted when the first connector housing 110 and the second connector housing 120 are fitted together and are released from the fitted state.

The fitting operation lever 130 includes, as shown, a pair of lever main bodies 131 which are disposed opposite to each other so as to hold a pair of outer surfaces of the first connector housing 110 therebetween, a connecting member 132 which connects together end portions of the pair of lever main bodies 131, rotation fulcrum holes 133 which are formed in the lever main bodies 131 for rotatable engagement with the boss portions 111 on the outer surfaces of the first connector housing 110, and action point projecting portions 134 which are brought into engagement with lever locking holes 122 which are formed in outer surfaces of the outer cylindrical wall portion 121 when fitting is started where the first connector housing 110 and the second connector housing 120 are positioned in a fitting start position.

In the case of the illustrated example, the connecting member 132 doubles as an application point portion which receives an operation force with which the lever main bodies 131 are rotated on the boss portions 111 as a rotational center.

In the lever-type connector 100 of Patent Document 1, the first connector housing 110 and the second connector housing 120 are fitted together in the following procedure.

Firstly, as shown in the figure, the fitting operation lever 130 is mounted rotatably on the first connector housing 110. Next, as indicated by an arrow 1 in FIG. 23, a distal end portion of the first connector housing 110 is inserted into the outer cylindrical wall portion 121 of the second connector housing 120, so that the first connector housing 110 and the second connector hosing 120 are aligned with the fitting starting position, bringing the action point projecting portions 134 of the fitting operation lever 130 into engagement with the lever locking holes 122 in the second connector housing 120.

Next, by pressing downwards the connecting member 132 of the fitting operation lever 130, the fitting operation lever 130 is rotated as indicated by an arrow R1 in FIG. 23. The second connector housing 120 is pulled towards the first connector housing 110 by means of the rotational operation of the fitting operation lever 130, whereby the connector housings are completely fitted together.

When the fitting of the connector housings is released, the connecting member 132 is rotated in an opposite direction to the direction indicated by the arrow R1 in FIG. 23, whereby the connector housings are separated from each other.

PRIOR ART DOCUMENT

Patent Document

[Patent Document 1] Japanese Patent No. 3442661

SUMMARY OF THE INVENTION

Problem that the Invention is to Solve

In the case of the lever-type connector 100 of Patent Document 1, however, the fitting operation lever 130 cannot be dismounted from the first connector housing 110 with the connector housings fitted together.

Because of this, in the case of the lever-type connector 100 of Patent Document 1, the weight of the fitting operation lever 130 is still acting on the connector housings even in an actual used state where the housings are fitted completely together, constituting a cause for increasing the weight of the connector.

Additionally, in the case of the lever-type connector 100 of Patent Document 1, the fitting operation lever 130 has to be attached to the lever-type connector 100 at all times, leading to a problem that an increase in cost due to the increase in the number of parts occurs.

Then, relating to solving the problems, an object of the invention is to provide a lever-type connector which can realize a reduction in cost by reducing the number of parts and a reduction in weight thereof when in use.

Means for Solving the Problem

The object of the invention is achieved by the following configurations.

(1) A lever-type connector, including a first connector housing;

a second connector housing having an outer cylindrical wall portion into which the first connector housing is inserted and configured to be fitted together with the first connector housing for connection; and a fitting operation lever which is rotatably mounted on the first connector housing as a lever member which reduces operation forces to be exerted when the first connector housing and the second connector housing are fitted together and are released from the fitted state;

wherein the fitting operation lever includes:

a pair of lever main bodies which are disposed opposite to each other so as to hold a pair of outer surfaces of the first connector housing therebetween;

rotation fulcrum holes which are formed in the lever main bodies which lie to be opposite to the outer surfaces of the first connector housing so as to be brought into rotational engagement with boss portions which are provided individually on the outer surfaces of the first connector housing so as to project therefrom;

boss guiding grooves which are formed on inner surfaces of the lever main bodies and depressed thereinto so as to enable an engagement or disengagement between the boss portions and the rotation fulcrum holes by allowing the lever main bodies to be placed on or displaced from the first connector housing along a direction in which the connector housings are fitted together;

action point projecting portions, which are provided on outer surfaces of the lever main bodies so as to project therefrom as a point of action of a lever, which are configured to be inserted through projecting portion guiding grooves formed on inner surfaces of the outer cylindrical wall portion to arrive at an engagement starting position inside the outer cylindrical wall portion at a fitting starting time when the first connector housing and the second connector housing are aligned with a fitting starting position in a state that the rotation fulcrum holes are brought into rotational engagement with the boss portions, and which are configured to be brought into engagement with projection engagement projecting portions formed adjacent to the projecting portion guiding grooves on the inner surfaces of the outer cylindrical wall portion so as to apply a force acting in the direction in which the connector housings are fitted together to the second connector housing when the action point projecting portions move as a result of the rotation of the fitting operation lever from the engagement starting position; and an application point portion which receives an operation force that is applied to rotate the lever main bodies on the boss portions as a rotational center, wherein the rotation fulcrum holes are formed into an elliptic shape which enables the action point projecting portions to be disengaged from the projection engagement projecting portions inside the outer cylindrical wall portion without applying the force acting in the fitting direction to the second connector housing so as to return to the projecting portion guiding grooves as a result of their contact positions with the boss portions moving when the fitting operation lever is rotated in a returning direction after the connector housings are fitted together for connection.

(2) The lever-type connector according to (1) above, wherein the fitting operation lever includes an elastic arm which extends from the lever main bodies along the direction in which the first connector housing is fitted in the second connector housing, a guiding path switching projection which is formed to project from a distal end side of the elastic arm in a direction orthogonal to the fitting direction, and a half-fitting detecting step portion which is formed near the guiding path switching projection, and wherein the second connector housing includes:

a first guiding path, which is configured to restrict the guiding path switching projection so as to be positioned outwards to hold the elastic arm in an outwardly deflected state when the connector housings are fitted together halfway, and which is configured to release the restriction on the position of the guiding path switching projection so as to guide the guiding path switching projection to a normal arriving position where there is produced no deflection in the elastic arm by a restoring force of the elastic arm when the connector housings are fitted together completely;

a second guiding path which is configured to guide the guiding path switching projection in the normal arriving position so as to move freely in a direction in which the connector housings are disengaged from each other; and a half-fitting detecting projection, which is disposed to face the first guiding path, and which is configured to be brought into engagement with the half-fitting detecting step portion to restrict the movement of the fitting operation lever in the disengaging direction when the connector housings are positioned in the fitting starting position.

(3) The lever-type connector according to (2) above, wherein both surfaces of a single bulkhead portion which is formed into an outwardly curved shape along the fitting direction within the outer cylindrical wall portion define the first guiding path and the second guiding path.

According to the configuration of (1) above, with the connector housings being positioned in the fitting starting position, the action point projecting portions which function as a point of action of a lever are inserted through the projecting portion guiding grooves which are formed on the inner surfaces of the outer cylindrical wall portion to arrive at the engagement starting position inside the outer cylindrical wall portion.

Then, when the fitting operation lever which is mounted on the first connector housing is rotated in a predetermined direction in this state, the action point projecting portions are brought into engagement with the projection engagement projecting portions inside the outer cylindrical wall portion which lie adjacent to the projecting portion guiding grooves to thereby function as a lever member which causes the connector housings to move in the direction in which the connector housings are fitted together deeply, thereby causing the connector housings to be fitted together completely.

In addition, with the connector housings fitted together completely, when the fitting operation lever is rotated in the returning direction, the boss portions move in the elliptic rotation fulcrum holes, which moves the contact positions between the rotation fulcrum holes and the boss portions, whereby the action point projecting portions are disengaged from the projection engagement projecting portions within the outer cylindrical wall portion without applying the force acting in the fitting direction to the second connector housing to return into the projecting portion guiding grooves. The action point projecting portions within the projecting portion guiding grooves can move in a direction in which they are disengaged from the second connector housing. In addition, since the boss guiding grooves are provided in the lever main bodies, the fitting operation lever can be placed or removed along the direction in which the connector housings are fitted together, whereby the boss portions can be brought into engagement with or disengagement from the rotation fulcrum holes.

Because of this, with the action point projecting portions allowed to return into the projecting portion guiding grooves in the way described above, the fitting operation lever can simply be disengaged from both the connector housings by removing the fitting connection lever from the first connector housing.

Namely, according to the configuration of (1) above, after the connector housings are fitted together completely for connection, the fitting operation lever is disengaged from both the connector housings, thereby making it possible to realize a reduction in weight of the lever-type connector when in use.

The fitting operation lever which is so removed can be used to execute a fitting operation on another lever-type connector. This enables a normal parts set to be made up of only a first connector housing and a second connector housing excluding a fitting operation lever, thereby making it possible to realize a reduction in cost by reducing the number of parts involved in the parts set.

According to the configuration of (2) above, when the connector housings are fitted together completely in a proper fashion, the guiding path switching projection provided on the fitting operation lever passes through the first guiding path within the second connector housing to arrive at the normal arriving position. The guiding path switching projection in the normal arriving position can move freely in the direction in which the connector housings are disengaged from each other by being guided by the second guiding path, and therefore, the fitting operation lever can be disengaged from both the connector housings.

When the connector housings are fitted together halfway, however, the guiding path switching projection provided on the fitting operation lever is positioned halfway down in the first guiding path within the second connector housing. When the fitting operation lever is moved in the disengaging direction with the guiding path switching projection positioned halfway down in the first guiding path in the way described above, the half-fitting detecting step portion is brought into engagement with the half-fitting detecting projection within the second connector housing, whereby the fitting operation lever is restricted from moving in the disengaging direction.

Namely, according to the configuration of (2) above, in the event that the fitting operation lever cannot be disengaged from both the connector housings after the fitting operation of the connector housings has been completed, the connector housings are in the midst of being fitted together (fitted together halfway). Thus, it is possible to determine on the fitting conditions of the connector housings from the disengaging operation of the fitting operation lever, thereby making it possible to prevent the failure to locate a fitting error of the connector housings.

According to the configuration of (3) above, the two guiding paths of the first guiding path and the second guiding path can be defined by providing the single bulkhead portion, whereby the first guiding path and the second guiding path can be provided while suppressing the complexity of the construction of the second connector housing. Thus, the complexity of the construction of the second connector housing can be prevented.

Thus, the invention has been described briefly. Further, the details of the invention will be clarified further by perusing a mode for carrying out the invention (hereinafter, referred to as an "embodiment") that will be described below by reference to accompanying drawings.

MODE FOR CARRYING OUT THE INVENTION

Hereinafter, preferred embodiments of a lever-type connector according to the invention will be described in detail by reference to the drawings.

First Embodiment

Figure 1:
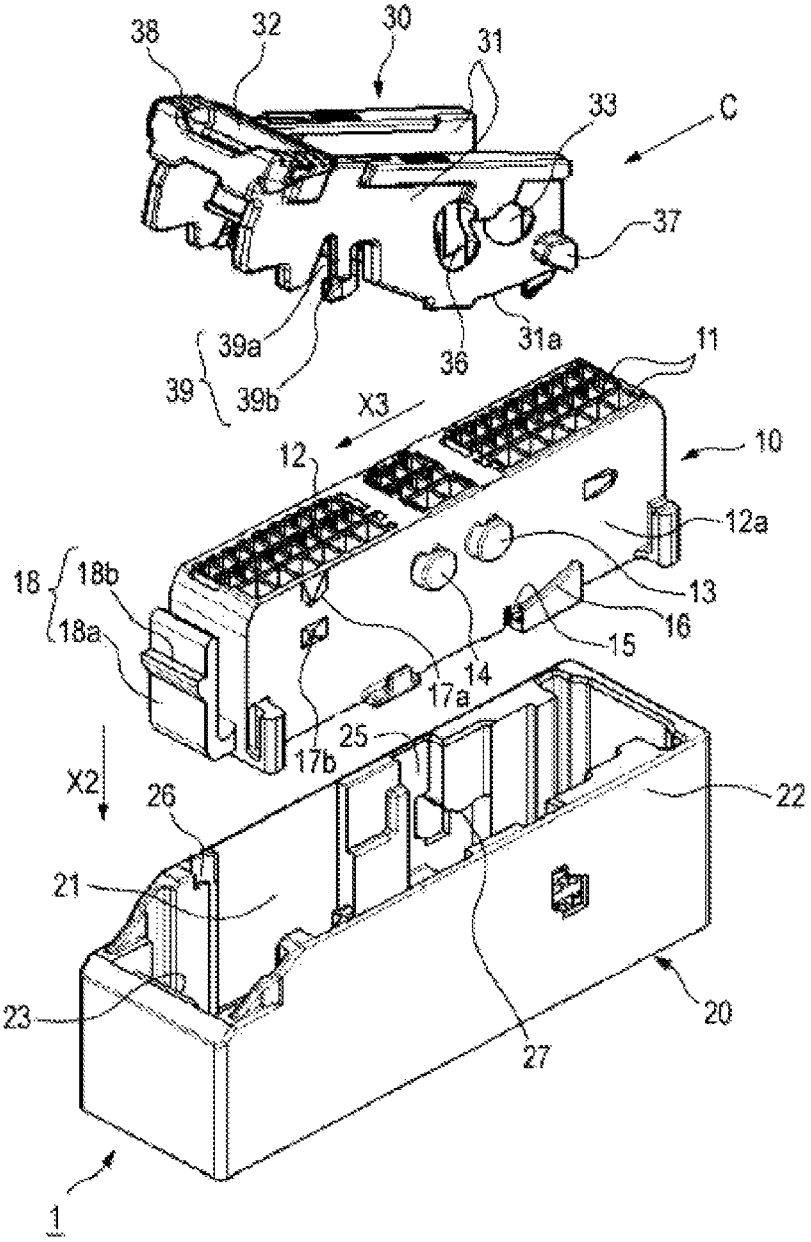
FIG. 1 is an exploded perspective view of a first embodiment of a lever-type connector according to the invention.
Figure 2:
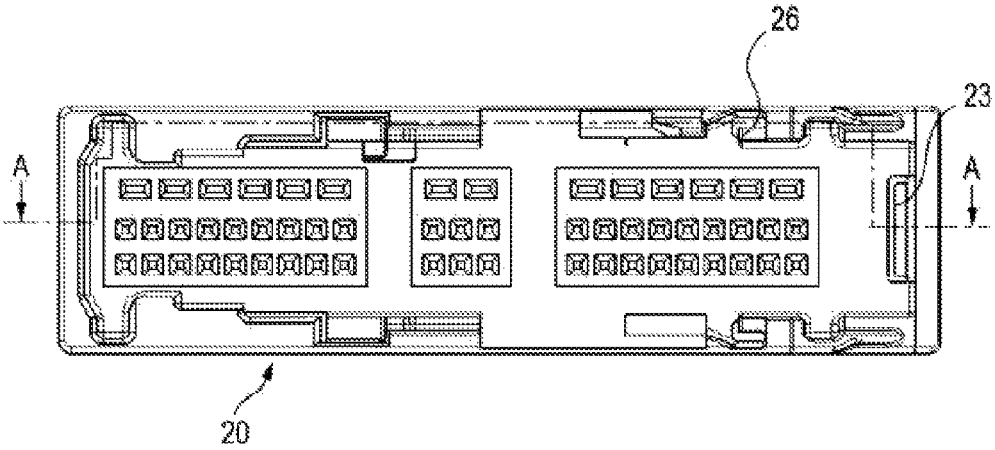
FIG. 2 is a plan view of a second connector housing shown in FIG. 1.
Figure 3:
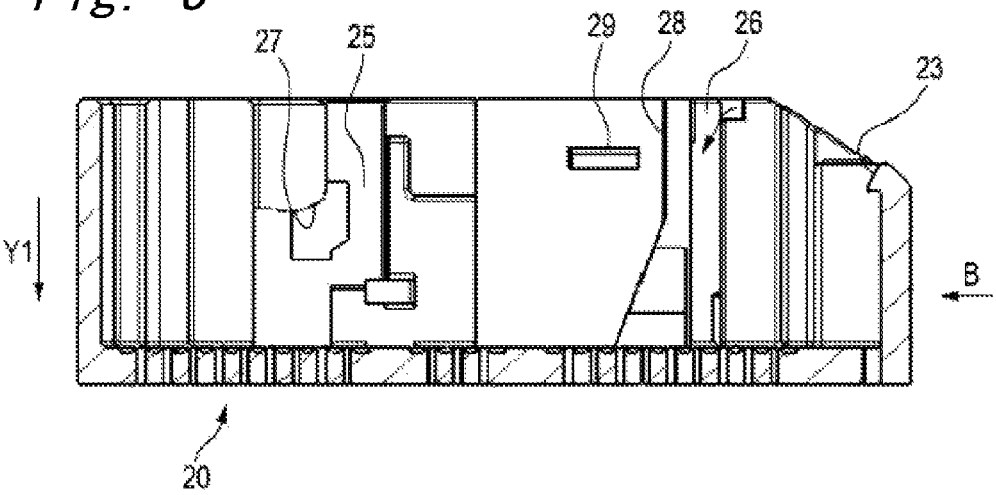
FIG. 3 is a sectional view taken along the line A-A in FIG. 2.

FIGS. 1 to 6 show a first embodiment of a lever-type connector according to the invention. FIG. 1 is a perspective view of the lever-type connector of the first embodiment. FIG. 2 is a plan view of a second connector housing shown in FIG. 1. FIG. 3 is a sectional view taken along the line A-A in FIG.

Figure 4:
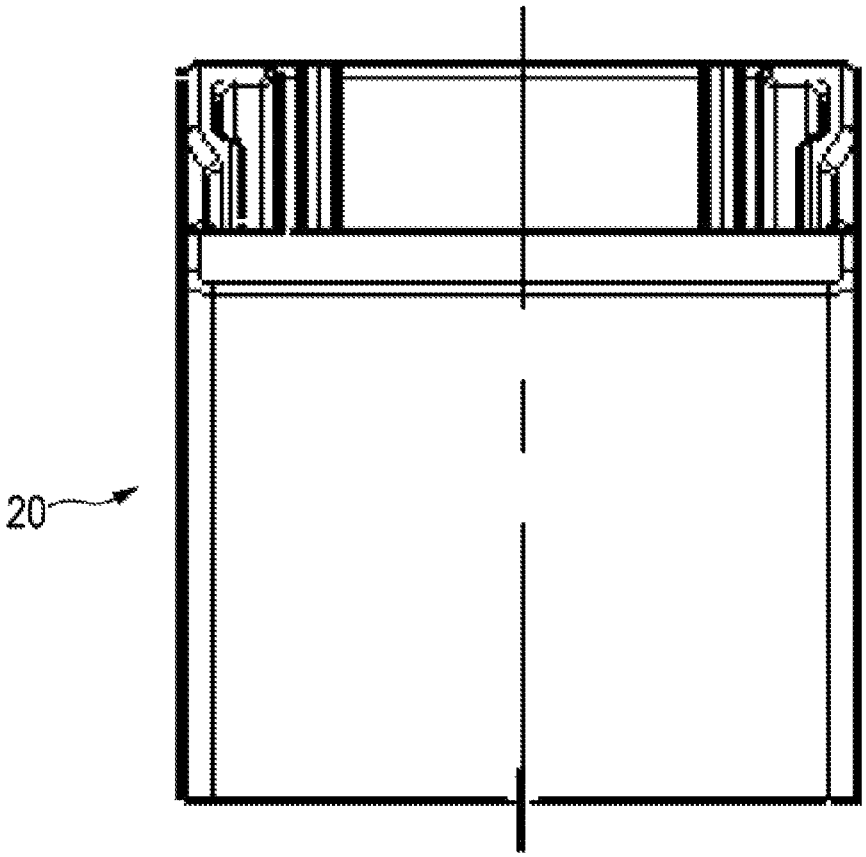
FIG. 4 is a view as seen in a direction indicated by an arrow B in FIG. 3.
Figure 5:
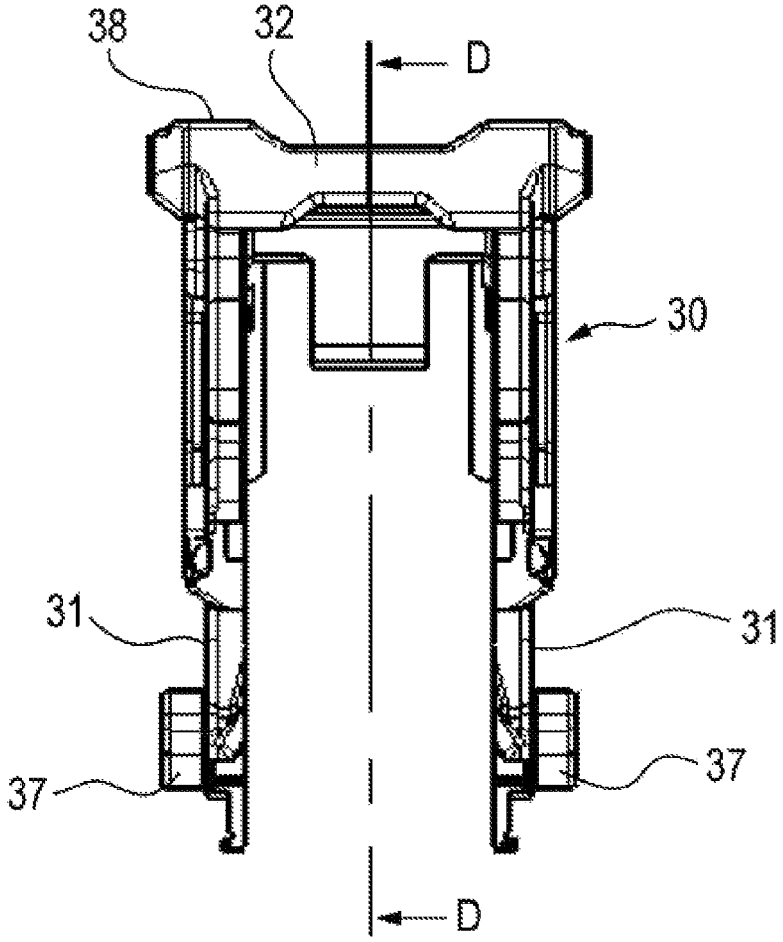
FIG. 5 is a rear view of a fitting operation lever shown in FIG. 1 (a perspective view as seen in a direction indicated by an arrow C in FIG. 1).
Figure 6:
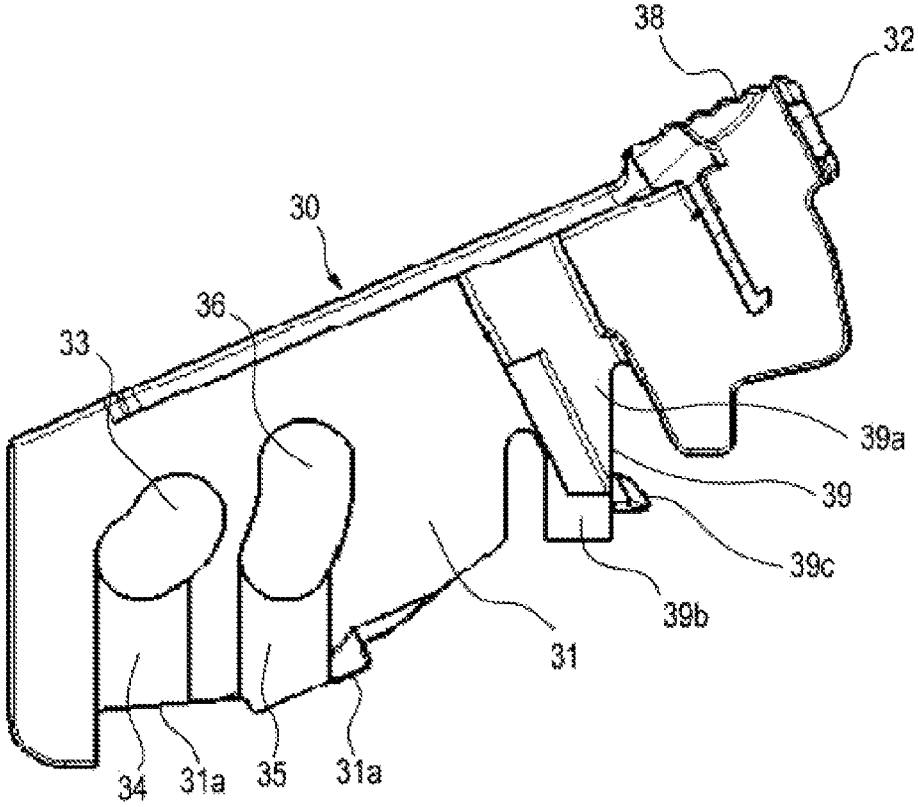
FIG. 6 is a sectional view taken along the line D-D in FIG. 5.

2. FIG. 4 is a view as seen in a direction indicated by an arrow in FIG. 3. FIG. 5 is a rear view (a view as seen in a direction indicated by an arrow C in FIG. 1) of a fitting operation lever shown in FIG. 1. FIG. 6 is a sectional view taken along the line D-D in FIG. 5.

This lever-type connector 1 of the first embodiment includes, as shown in FIG. 1, a first connector housing 10, a second connector housing 20 in which the first connector housing 10 is fitted for connection, and a fitting operation lever 30 which is rotatably mounted on the first connector housing 10.

As shown in FIG. 1, the first connector housing 10 includes a terminal accommodating portion 12 in which a number of terminal accommodating holes 11 are arranged, boss portions 13 which are provided on both outer surfaces 12*a* of the terminal accommodating portion 12 so as to project therefrom to thereby support rotatably a fitting operation lever 30, lever placement restricting boss portions 14 which are disposed on the outer surfaces 12*a* so as to lie close to the boss portions 13, lever guiding ribs 16 which define guiding grooves 15 through which lever main bodies 31 of the fitting operation lever 30, which will be described later, pass so that the lever main bodies 31 do not move away from the outer surfaces 12*a*, pairs of positioning projections 17*a*, 17*b* which restrict the position of the fitting operation lever 30 which is mounted on the first connector housing 10 to an initial position, and a locking piece 18 which is brought into engagement with the second connector housing 20 when the connector housings are fitted together completely to hold them in a joined state.

The outer surfaces 12*a* of the terminal accommodating portion 12 constitute outer surfaces of the first connector housing 10.

The lever insertion restricting boss portions 14 are provided so as to be spaced apart from the corresponding boss portions 13 in a horizontal direction (in a direction indicated by an arrow X3 in FIG. 1). The lever placement restricting boss portions 14 are provided to restrict a direction in which the fitting operation lever 30, which will be described later, is placed when the fitting operation lever 30 is placed on the first connector housing 10 so as to be mounted thereon.

The lever guiding ribs 16 define the guiding grooves 15 through which lower edge portions of the lever main bodies 31, which will be described later, are inserted when the fitting operation lever 30 is rotated and are provided at front end sides of the outer surfaces 12*a* as shown in FIG. 1. The lever guiding ribs 16 restrict the lever main bodies 31 from being deflected and displaced in an outward direction which is orthogonal to the outer surfaces 12*a* when the lever main bodies 31 are rotated.

The pair of positioning projections 17*a*, 17*b* position the lever main bodies 31, which will be described later, in the initial position with engagement portions 39*b* on the lever main bodies 31, which will be described later, held between the pair of positioning projections 17*a*, 17*b*. When referred to here, the initial position means a mounting position where action point projecting portions 37 which are provided on the lever main bodies 31, which will be described later, arrive at an engagement starting position within the second connector housing 20, which will be described later, when the first connector housing 10 and the second connector housing 20 are aligned with a fitting starting position.

As shown in FIG. 1, the locking piece 18 includes an elastic piece 18*a* which extends from a front end side towards a rear end side of the terminal accommodating portion 12 along a direction in which the connector housings are fitted together (a direction indicated by an arrow X2 in FIG. 1), and an engagement projection 18*b* which is provided on the elastic piece 18*a* so as to project therefrom.

The second connector housing 20 has an outer cylindrical wall portion (a hood portion) 22 which defines a fitting space 21 into which the first connector housing 10 is inserted, as shown in FIG. 1. An external surface of the outer cylindrical wall portion 22 provides an external appearance of the second connector housing 20.

The second connector housing 20 of this embodiment includes, as shown in FIGS. 1 and 3, a locking projection 23, projecting portion guide grooves 25, temporary locking releasing raceways 26, projection engagement projecting portions 27, a bulkhead portion 28 which defines two guiding paths for detecting a fitting error, and a half-fitting detecting projection 29 which detects a fitting error.

As shown in FIGS. 1 and 2, the locking projection 23 is provided on an inner surface of the outer cylindrical wall portion 22 which is opposite to the locking piece 18 on the first connector housing 10. This locking projection 23 is brought into engagement with the engagement projection 18*b* of the locking piece 18 to thereby join the connector housing together when the connector housings are fitted together completely.

The projecting portion guiding grooves 25 are grooves through which the action point projecting portions 37 on the fitting operation lever 30, which will be described later, are inserted when the first connector housing 10 on which the fitting operation lever 30 is mounted is fitted in the second connector housing 20 and are formed on inner surfaces of the outer cylindrical wall portion 22. The projecting portion guiding grooves 25 extend along the direction in which the connector housings are fitted together (a direction indicated by an arrow Y1 in FIG. 3) and allow the action point projecting portions 37 to arrive at an engagement starting position P1 (refer to FIG. 8) inside the outer cylindrical wall portion 22 when the first connector housing 10 and the second connector housing 20 are started to be fitted together where the first connector housing 10 and the second connector housing 20 are aligned with the fitting starting position.

The temporary locking releasing raceways 26 are raceways which guide locking releasing projections 39*c* (refer to FIG. 6) of the fitting operation lever 30, which will be described later. When the first connector housing 10 and the second connector housing 20 are fitted together, the locking releasing projections 39*c* pass through the temporary locking releasing raceways 26, and a temporary locked state of the fitting operation lever 30 in the initial position by the positioning projections 17*a*, 17*b* on the first connector housing 10 is released, whereby the fitting operation lever 30 is allowed to rotate around the boss portions 13.

The projection engagement projecting portions 27 are projecting portions (projecting curved surfaces) which are formed to lie adjacent to the projecting portion guiding grooves 25 on the inner surfaces of the outer cylindrical wall portion 22 so as to be brought into engagement (ride) with (on) the action point projecting portions 37 when the action point projecting portions 37 move from the engagement starting position P1 on the projecting portion guiding grooves 25 in association with the rotation of the fitting operation lever 30. The projection engagement projecting portions 27 receive a force acting in the fitting direction of the connector housings from the action point projecting portions 37 in association with the rotation of the fitting operation lever 30

The bulkhead portion 28 and the half-fitting detecting projection 29 on the second connector housing 20 will be described in a second embodiment which will be described later.

The fitting operation lever 30 is rotatably mounted on the first connector housing 10 as a lever member which reduces operation forces to be exerted when the first connector housing 10 and the second connector housing 20 are fitted together and are released from the fitted state.

As shown in FIGS. 1 and 6, the fitting operation lever 30 includes a pair of lever main bodies 31 which are disposed opposite to each other so as to hold the pair of outer surfaces 12*a* of the first connector housing 10 therebetween, a connecting member 32 which connects together end portions of the pair of lever main bodies 31, rotation fulcrum holes 33 which are brought into engagement with the boss portions 13 on the first connector housing 10, boss guiding grooves 34 which communicate with the rotation fulcrum holes 33, placement restricting grooves 35 which are disposed close to the boss guiding grooves 34, lever placement restricting fitting holes 36, the action point projecting portions 37, an application point portion 38, and temporary locking arms 39.

The pair of lever main bodies 31 are lever members which are placed on the pair of outer surfaces 12*a* of the second connector housing 10.

The connecting member 32 joins the end portions of the pair of lever members 31 to integrate them with each other, as also shown in FIG. 5.

As shown in FIG. 1, the rotation fulcrum hole 33 is an elliptic hole which is formed to penetrate through the lever main body 31 which is positioned opposite to the outer surface 12*a* of the first connector housing 10. This rotation fulcrum hole 33 is brought into rotational engagement with the boss portion 13 which is provided on the outer surface 12*a* of the first connector housing 10 so as to project therefrom and makes the boss portion 13 function as a rotational fulcrum of a lever.

Figure 10:
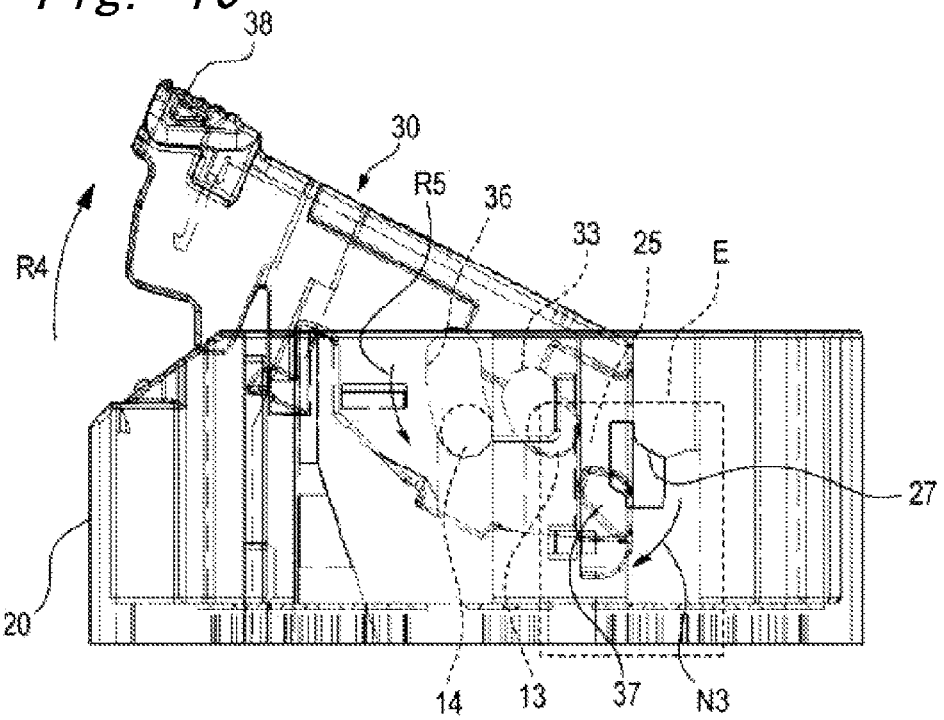
FIG. 10 is a side view showing a state in which the rotation of the fitting operation lever is reversed so as to return action point projecting portions into projecting portion guiding grooves in order to disengage the fitting operation lever from the connector housings after the connector housings are fitted together completely.
Figure 11:
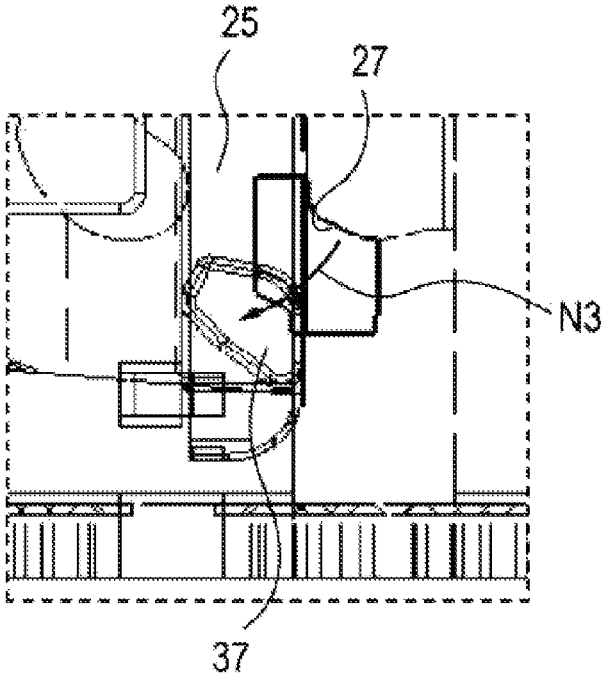
FIG. 11 is an enlarged view of a portion E in FIG. 10.

The rotation fulcrum holes 33 are each formed into an elliptic shape which enables the action point projecting portions 37 to be disengaged from the projection engagement projecting portions 27 inside the outer cylindrical wall portion 22 without applying the force acting in the fitting direction to the second connector housing 20 so as to return to the projecting portion guiding grooves 25 as a result of their contact positions with the boss portions 13 moving along a direction in which the holes extend when the fitting operation lever 30 is rotated in a returning direction as shown in FIG. 10 after the connector housings are completely fitted together for connection.

The boss guiding grooves 34 are grooves which are formed on inner surfaces of the lever main bodies 31 so as to be depressed thereinto so that the boss portions 13 can be inserted therethrough. As shown in FIG. 6, the boss guiding groove 34 extends from the rotation fulcrum hole 33 to a lower edge 31*a* of the lever main body 31 along the fitting direction of the connector housings (in the direction indicated by the arrow X2 in FIG. 1) and is opened in the lower edge 31*a*. The boss guiding grooves 34 enable an engagement or disengagement between the boss portions 13 and the rotation fulcrum holes 33 by allowing the lever main bodies 31 to be placed on or displaced from the first connector housing 10 along the fitting direction the connector housings (the direction indicated by the arrow X2 in FIG. 1).

The placement restricting grooves 35 are grooves which are formed on the inner surfaces of the lever main bodies 31 so as to be depressed thereinto so that the lever placement restricting boss portions 14 can be inserted therethrough. The placement restricting grooves 35 are formed substantially parallel to the boss guiding grooves 34.

The lever placement restricting boss portions 14 are inserted through the placement restricting grooves 35 when the fitting operation lever 30 is placed to be mounted on the first connector housing 10, whereby the fitting operation lever 30 is prevented from being inclined inadvertently, thereby making it possible to facilitate the placement and mounting of the fitting operation lever 30 on the first connector housing 10.

As shown in FIG. 1, the lever placement restricting hole 36 is an elliptic hole which is formed to penetrate through the lever main body 31 which is positioned opposite to the outer surface 12*a* of the first connector housing 10. As shown in FIG. 6, the lever placement restricting hole 36 is a hole which is formed in a terminating end of the placement restricting groove 35 so that the lever placement restricting boss portion 14 is brought into rotatable and slidable engagement therewith when the lever placement restricting boss portion 14 moves to a terminating end side of the placement restricting groove 35. This lever placement restricting hole 36 restricts the rotating posture of the fitting operation lever 30 as a result of the lever placement restricting boss portion 14 sliding therein when the fitting operation lever 30 rotates.

The action point projecting portion 37 is a projecting portion which is provided on an outer surface of the lever main body 31 as a point of action of a lever. When the first connector housing 10 on which the rotation fulcrum holes 33 are in rotational engagement with the boss portions 13 and the second connector housing 20 are started to be fitted together where the first connector housing 10 and the second connector housing 20 are aligned with the fitting starting position, the action point projecting portions 37 are inserted through the projecting portion guiding grooves 25 which are formed on the inner surfaces of the outer cylindrical wall portion 22 and then arrive at the engagement initial positions P1 inside the outer cylindrical wall portion 22 (refer to FIG. 8). Then, when the action point projecting portions 37 move from the engagement starting positions P1 in a direction in which the action point projecting portions 37 cross the projecting portion guiding grooves 25 in association with the rotation of the fitting operation lever 30, the action point projecting portions 37 are brought into engagement with the projection engagement projecting portions 27 which are formed to lie adjacent to the projecting portion guiding grooves 25 on the inner surfaces of the outer cylindrical wall portion to thereby apply a force acting in the fitting direction of the connector housings to the second connector housing 20.

The application point portion 38 is a portion which receives an operation force with which the lever main bodies 31 are rotated on the boss portions 13 as a center of rotation. In this embodiment, portion of an external surface of the connecting member 32 constitutes the application point portion 38.

As shown in FIGS. 1 and 6, the temporary locking arms 39 each include an elastic piece 39*a* which extends from the lever main body 31 along the outer surface 12*a*, an engagement portion 39*b* which is provided at a front end side of the elastic piece 39*a* and the locking releasing projection 39*c* which is provided in a position lying spaced slightly from the engagement portion 39*b*.

With the rotation fulcrum holes 33 in the lever main bodies 31 in rotational engagement with the boss portions 13 on the first connector housing 10, when the lever main bodies 31 are positioned in a predetermined angular position, the engagement portions 39*b* of the temporary locking arms 39 fit between the pairs of positioning projections 17*a*, 17*b* to thereby fix temporarily the fitting operation lever 30 at a predetermined inclination angle. This temporary fixed position is a so-called an initial position of the fitting operation lever 30. When the connector housings are aligned with the fitting starting position while the fitting operation lever 30 stays in the initial position, the action point projecting portions 37 can be positioned in the engagement starting position P1 in the second connector housing 20.

When the first connector housing 10 on which the fitting operation lever 30 is temporarily fixed in the initial position is fitted in the second connector housing 20, the locking releasing projections 39*c* on the temporary locking arms 39 pass through the temporary locking releasing raceways 26 shown in FIG. 3 to thereby deflect and displace the elastic pieces 39*a* outwards, whereby the engagement with the engagement portions 39*b* and the positioning projections 17*a*, 17*b* is released.

Namely, by passing through the temporary locking releasing raceways 26 shown in FIG. 3, the locking releasing projections 39*c* releases the temporarily locked state of the fitting operation lever 30, thereby enabling the fitting operation lever 30 to rotate on the boss portions 13 as a center of rotation.

Next, a method of fitting and connecting together the connector housings of the lever-type connector 1 of the first embodiment that has been described heretofore and a method of disengaging the fitting operation lever 30 after the connector housings are fitted and connected together will be described based on FIGS. 7 to 12.

Figure 7:
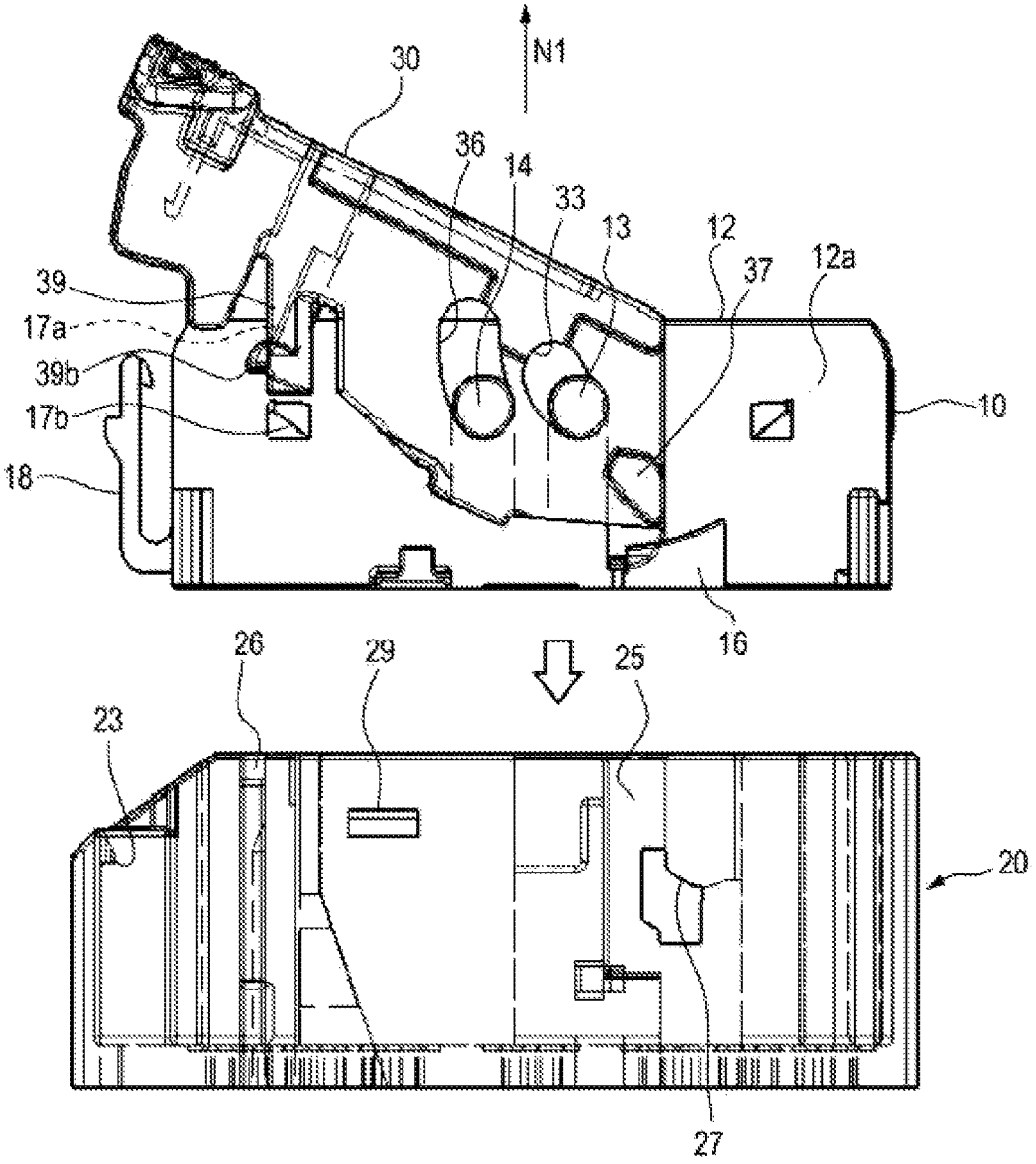
FIG. 7 is a side view showing a state in which a first connector housing on which the fitting operation lever shown in FIG. 1 is mounted and the second connector housing are disposed so as to be aligned vertically.

When the connector housings are fitted and connected together, as shown in FIG. 7, the first connector housing 10 on which the fitting operation lever 30 is mounted and the second connector housing 20 are disposed to be opposite to each other. The fitting operation lever 30 mounted on the first connector housing 10 can be removed from the first connector housing 10 by being pulled in a direction indicated by an arrow N1 in FIG. 7 with respect to the first connector housing 10. Additionally, the fitting operation lever 30 can be mounted rotatably on the first connector housing 10 in a simple fashion by being lowered in a reverse direction to the direction indicated by the arrow N1 in FIG. 7 in relation to the first connector housing 10.

It is noted that the fitting operation lever 30 which is mounted on the first connector housing 10 is set to the initial position where the engagement portions 39*b* of the temporary locking arms 39 are fitted between the positioning projections 17*a*, 17*b* on the first connector housing 10 for engagement therewith, as shown in FIG. 7.

Figure 8:
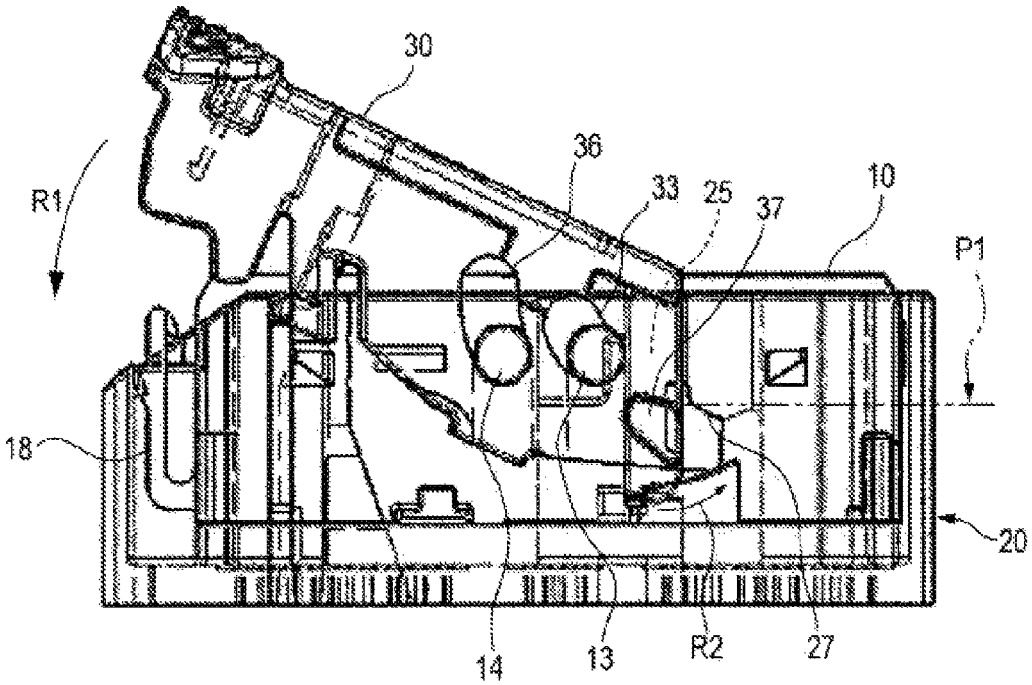
FIG. 8 is a side view showing a state resulting when the first connector housing and the second connector housing which are shown in FIG. 7 are started to be fitted together where the first connector housing and the second connector housing are aligned with a fitting starting position.

Next, the connector housings which are disposed opposite to each other are aligned with the fitting starting position as shown in FIG. 8. By aligning the connector housings with the fitting starting position, the action point projecting portions 37 of the fitting operation lever 30 arrive at the engagement starting positions P1 on the projecting portion guiding grooves 25 within the outer cylindrical wall portion 22. Additionally, by the locking releasing projections 39*c* of the temporary locking arms 39 of the fitting operation lever 30 passing through the temporary locking releasing raceways 26 of the second connector housing 20, the temporary locked state of the fitting operation lever 30 by the positioning projections 17*a*, 17*b* is released, whereby the fitting operation lever 30 is allowed to rotate around the boss portions 13 as the center of rotation.

Figure 9:
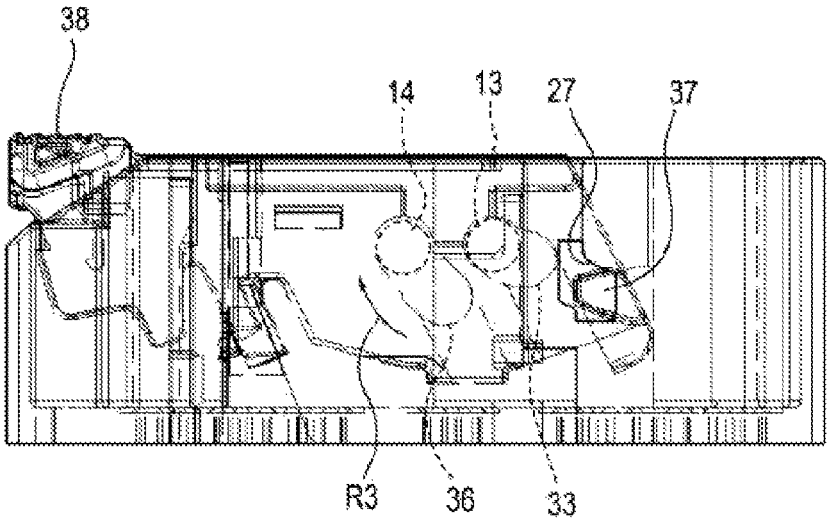
FIG. 9 is a side view showing a state in which the first connector housing and the second connector housing which are shown in FIG. 7 are fitted together completely for connection by the rotation of the fitting operation lever.

Then, the application point portion 38 of the fitting operation lever 30 is rotated from the state where the connector housings are aligned with the fitting starting position shown in FIG. 8 in a direction indicated by an arrow R1, the action point projecting portions 37 cross the projecting portion guiding grooves 25 to move towards the projection engagement projecting portions 27 as shown in a direction indicated by an arrow R2 in FIG. 8 in association with the rotation of the fitting operation lever 30, whereby the action point projecting portions 37 are brought into engagement with (ride on) the projection engagement projecting portions 27 thereon. A force acting in a direction in which the fitting of the connector housings is progressed is applied from the action point projecting portions 37 to the second connector housing 20 via the projection engagement projecting portions 27 as a result of the action point projecting portions 37 being brought into engagement with the projection engagement projecting portions 27. Then, when the rotation of the fitting operation lever 30 is completed, as shown in FIG. 9, the connector housings are fitted together completely for connection. In such a state that the connector housings are fitted together completely for connection, the boss portions 13 in the rotation fulcrum holes 33 and the lever placement restricting boss portions 14 in the lever placement restricting fitting holes 36 slide to move in a direction indicated by an arrow R3 in FIG. 9 in their holes to arrive at end portions of the holes which lie opposite to end portions where the boss portions 13 and the level placement restricting boss portions 14 stay when the connector housings are started to be fitted together.

In such a state that the connector housings are fitted together completely for connection, the locking piece 18 of the first connector housing 10 is in engagement with the locking projection 23 of the second connector housing 20, whereby the connection of the first connector housing 10 and the second connector housing 20 is locked.

Then, in such a state that the connector housings are fitted together completely for connection, when the fitting operation lever 30 is rotated in the returning direction as indicated by an arrow R4 in FIG. 10, the boss portions 13 in the rotation fulcrum holes 33 and the lever placement restricting boss portions 14 in the lever placement restricting fitting holes 36 slide to move in a direction indicated by an arrow R5 in FIG. 10 in their holes. The action point projecting portions 37 rotate and move in a direction in which the action point projecting portions 37 move away from the projection engagement projecting portions 27 as indicated by an arrow N3 in FIGS. 10 and 11 as the boss portions 13, 14 slide and return into the projecting portion guiding grooves 25. Namely, in such a state that the connector housings are fitted together completely for connection, when the fitting operation lever 30 is rotated in the returning direction, the engagement between the action point projecting portions 37 and the projection engagement projecting portions 27 is released, whereby the action point projecting portions 37 are allowed to return into the projecting portion guiding grooves 25.

Figure 12:
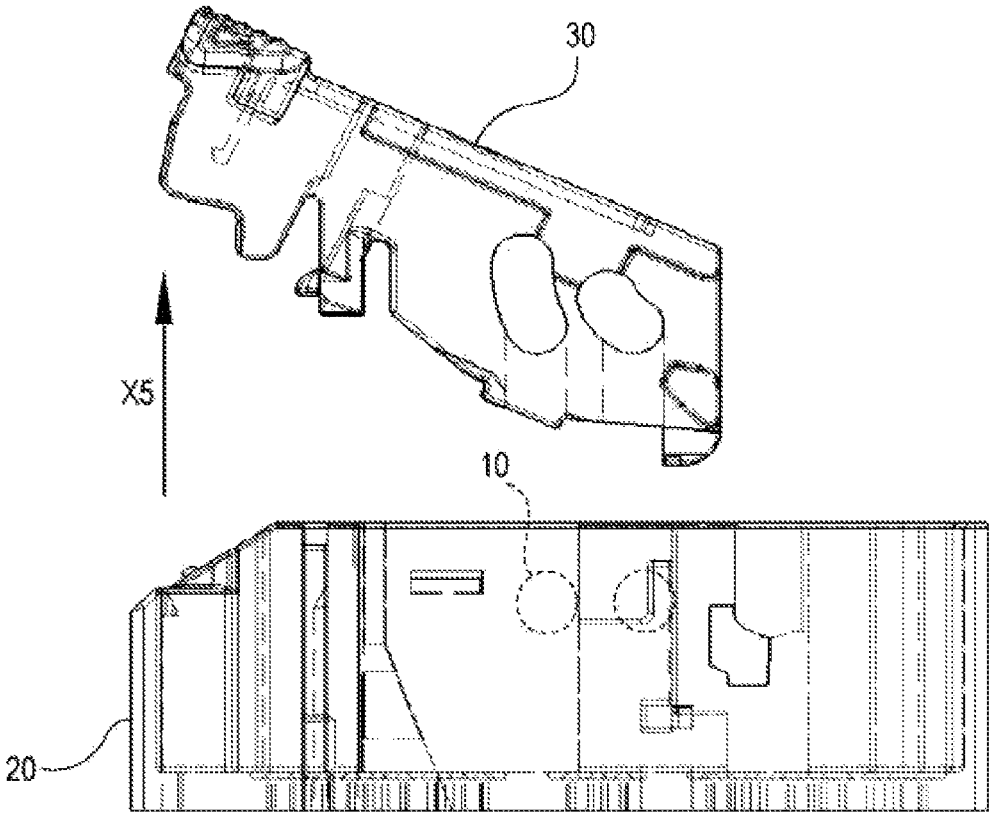
FIG. 12 is a side view showing a state in which the fitting operation lever is disengaged from the connector housings which are fitted together completely as shown in FIG. 10.

In such a state that the action point projecting portions 37 have returned into the projecting portion guiding grooves 25, when the fitting operation lever 30 is pulled in a direction indicated by an arrow X5 in FIG. 12, the fitting operation lever 30 can be disengaged from the first connector housing 10 and the second connector housing 20.

When the lever-type connector 1 is used normally, by disengaging the fitting operation lever 30 after the connector housings have been fitted together for connection, the weight of the lever-type connector 1 can be reduced.

Thus, according to the lever-type connector 1 of the first embodiment that has been described heretofore, with the connector housings aligned with the fitting starting position, the action point projecting portions 37 which function as a point of action of a lever have been inserted through the projecting portion guiding grooves 25 which are formed on the inner surfaces of the outer cylindrical wall portion 22 of the second connector housing 20 to arrive at the engagement starting positions P1 inside the outer cylindrical wall portion 22.

Then, when the fitting operation lever 30 which is mounted on the first connector housing 10 is rotated in the predetermined direction in this state, the action point projecting portions 37 are brought into engagement with the projection engagement projecting portions 27 inside the outer cylindrical wall portion 22 which lie adjacent to the projecting portion guiding grooves 25 to thereby function as a lever member which causes the connector housings to move in the direction in which the connector housings are fitted together deeply, thereby causing the connector housings to be fitted together completely.

In addition, with the connector housings fitted together completely, when the fitting operation lever 30 is rotated in the returning direction, the boss portions 13 move in the elliptic rotation fulcrum holes 33, which moves the contact positions between the rotation fulcrum holes 33 and the boss portions 13, whereby the action point projecting portions 37 are disengaged from the projection engagement projecting portions 27 within the outer cylindrical wall portion 22 without applying the force acting in the fitting direction to the second connector housing 20 to return into the projecting portion guiding grooves 25. The action point projecting portions 37 within the projecting portion guiding grooves 25 can move in a direction in which they are disengaged from the second connector housing 20. In addition, since the boss guiding grooves 34 and the placement restricting grooves 35 are provided in the lever main bodies 31, the fitting operation lever 30 can be placed or removed along the direction in which the connector housings are fitted together, whereby the boss portions 13 can be brought into engagement with or disengagement from the rotation fulcrum holes 33.

Because of this, with the action point projecting portions 37 allowed to return into the projecting portion guiding grooves 25 in the way described above, the fitting operation lever 30 can simply be disengaged from both the connector housings by removing the fitting connection lever 30 from the first connector housing 10.

Namely, according to the configuration of the lever-type connector 1 of the first embodiment, after the connector housings are fitted together completely, the fitting operation lever 30 is disengaged from both the connector housings, thereby making it possible to realize a reduction in weight of the lever-type connector when in use.

The fitting operation lever 30 which is so disengaged can be used to execute a fitting operation on another lever-type connector. This enables a normal parts set for the fitting operation lever 30 to be made up of only a first connector housing 10 and a second connector housing 20 excluding a fitting operation lever 30, thereby making it possible to realize a reduction in cost by reducing the number of parts involved in the parts set.

Next, a second embodiment of a lever-type connector according to the invention will be described based on FIGS. 13 to 22.

Figure 13:
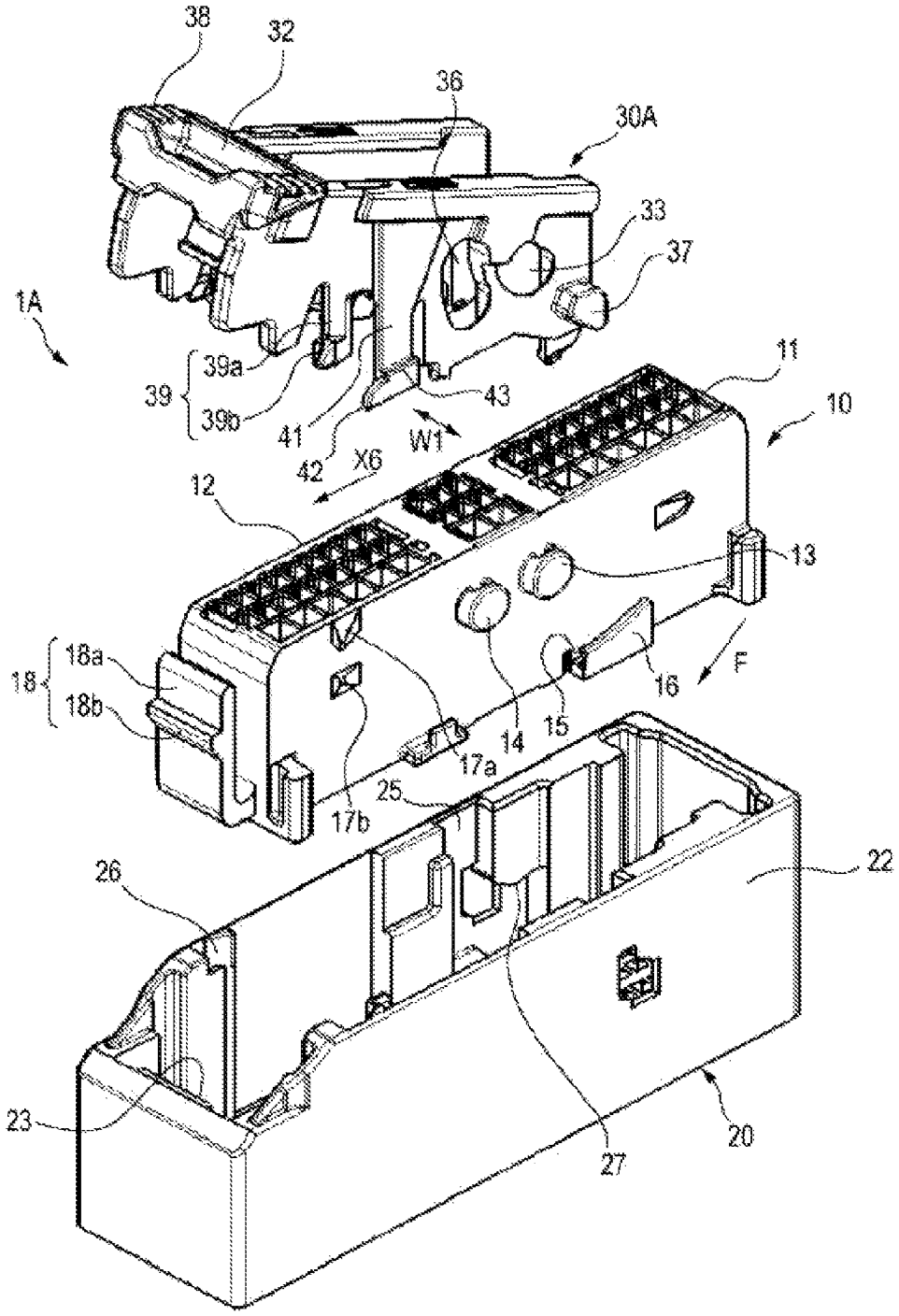
FIG. 13 is an exploded perspective view of a second embodiment of a lever-type connector according to the invention.
Figure 14:
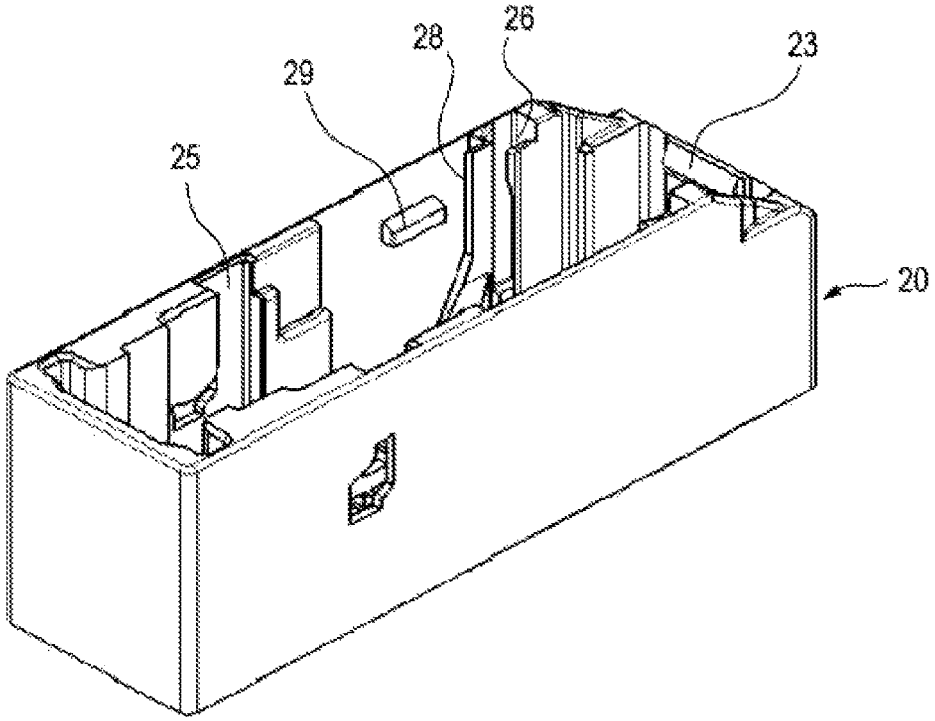
FIG. 14 is a perspective view of a second connector housing shown in FIG. 13 as seen in a direction indicated by an arrow F.
Figure 15:
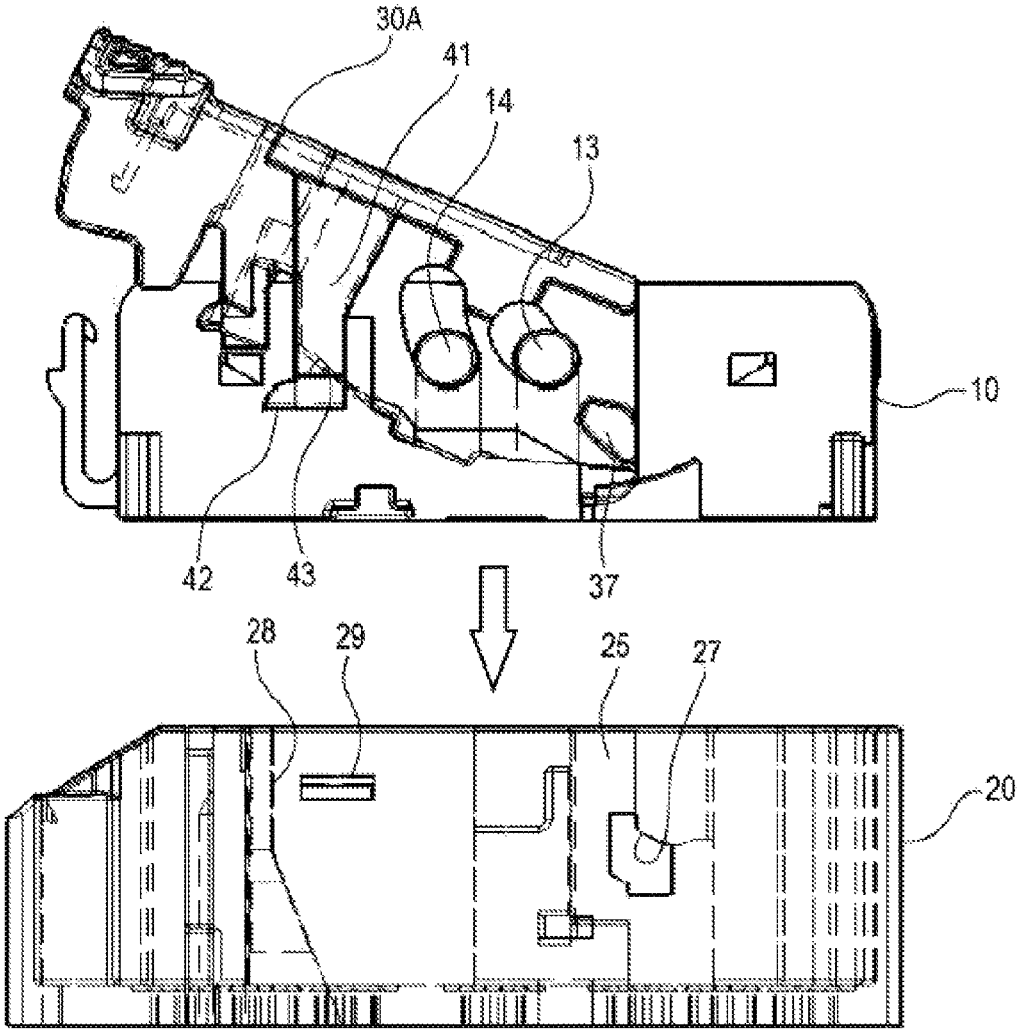
FIG. 15 is a side view showing a state in which a first connector housing on which a fitting operation lever shown in FIG. 13 is mounted and the second connector housing are disposed so as to be aligned vertically.
Figure 16:
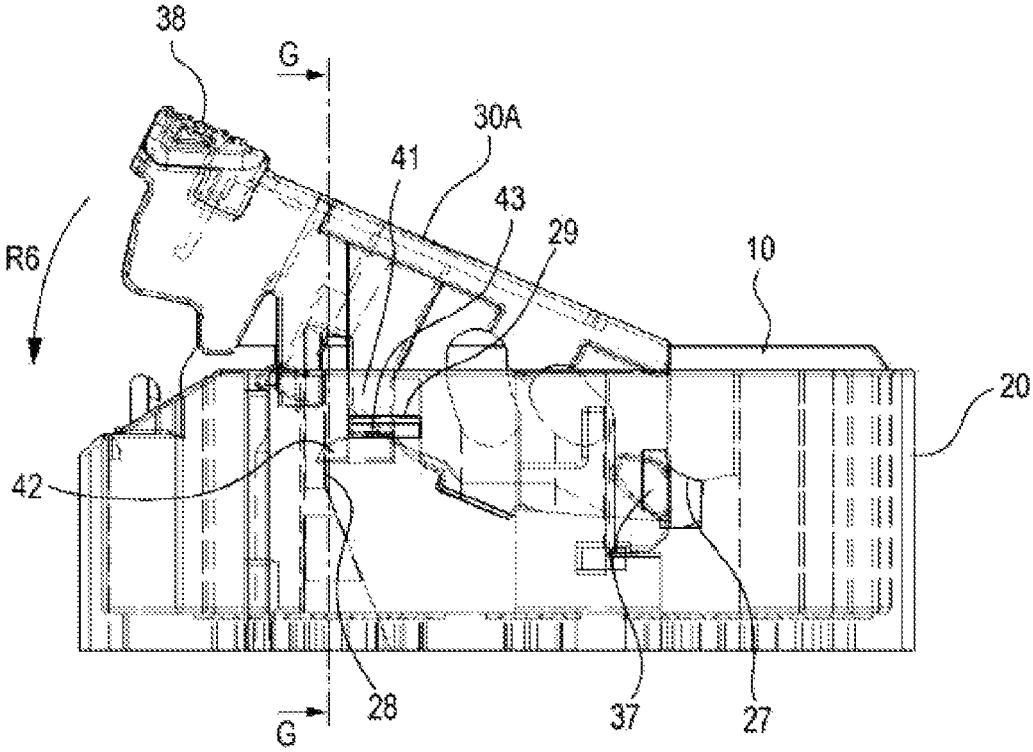
FIG. 16 is a side view showing a state resulting when the first connector housing and the second connector housing which are shown in FIG. 15 are started to be fitted together where the first connector housing and the second connector housing are aligned with a fitting starting position.
Figure 17:
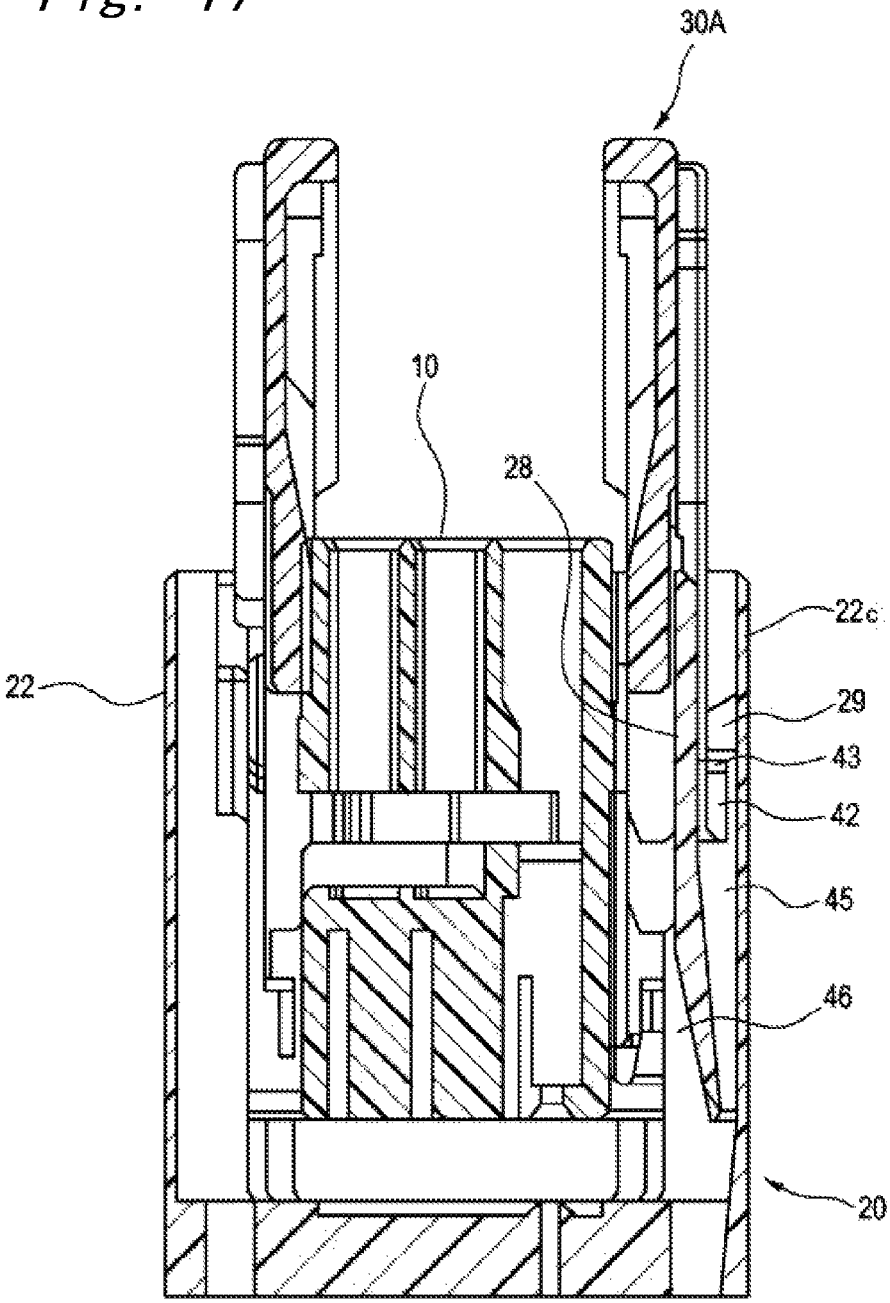
FIG. 17 is a sectional view taken along the line G-G in FIG. 16.
Figure 18:
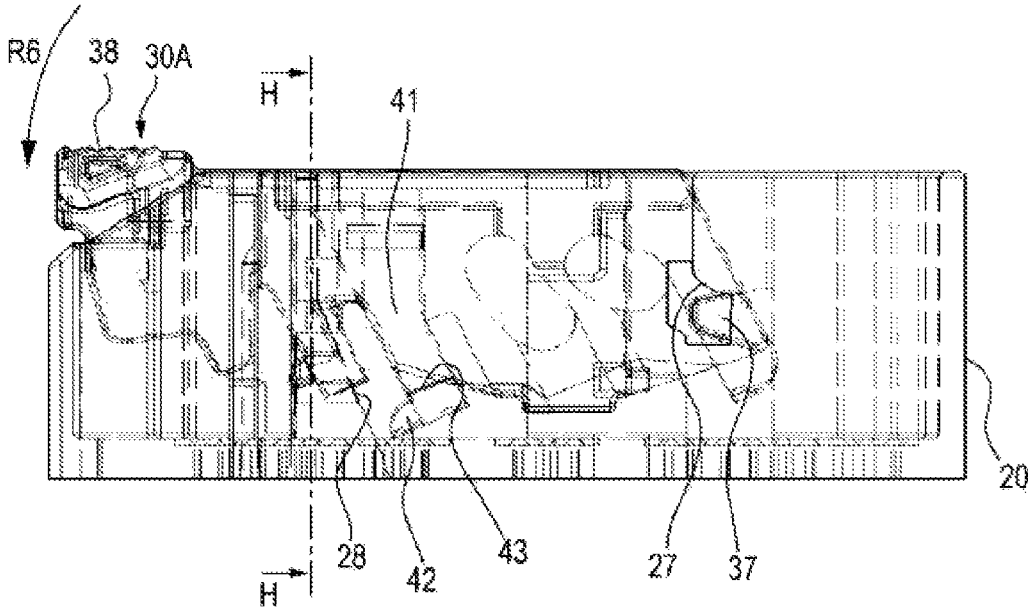
FIG. 18 is a side view showing a state in which the first connector housing and the second connector housing which are shown in FIG. 16 are fitted together completely for connection by the rotation of the fitting operation lever.
Figure 19:
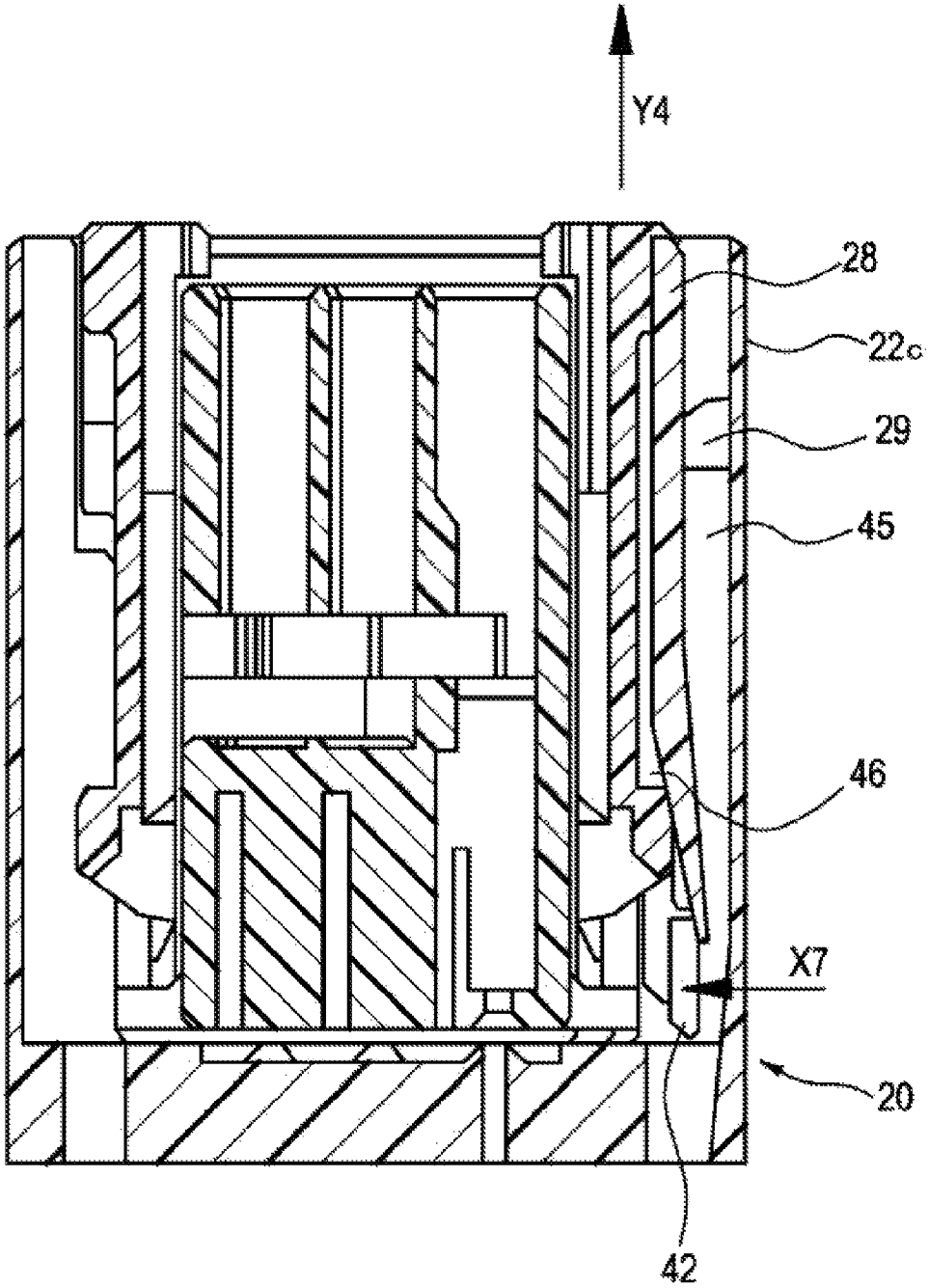
FIG. 19 is a sectional view taken along the line H-H in FIG. 18.
Figure 20:
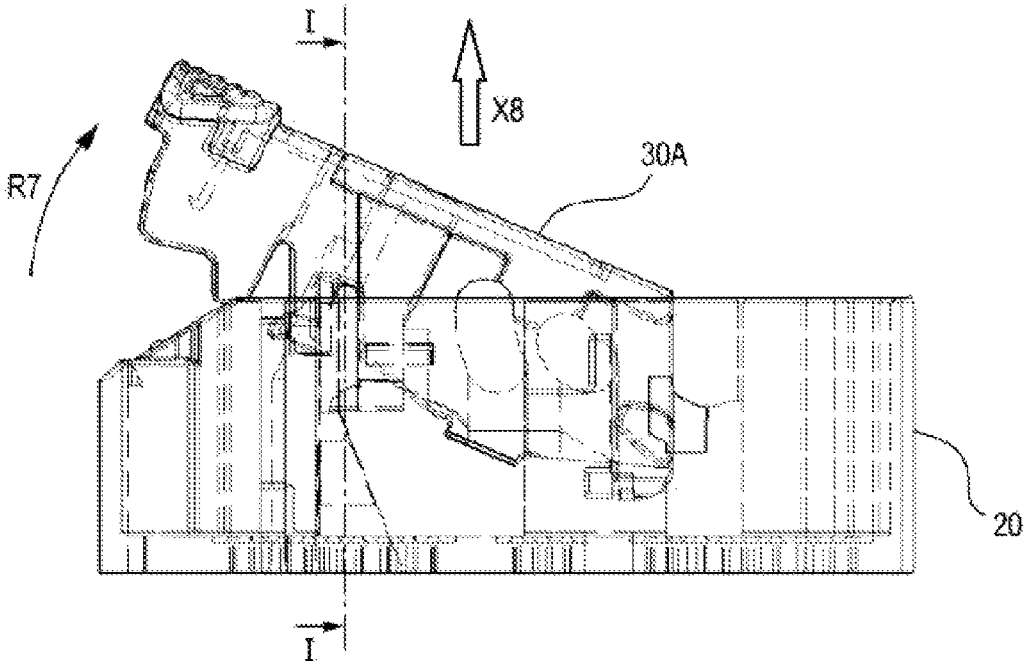
FIG. 20 is a side view showing a state in which the rotation of the fitting operation lever is reversed so as to return action point projecting portions into projecting portion guiding grooves in order to disengage the fitting operation lever from the connector housings after the connector housings are fitted together completely.
Figure 21:
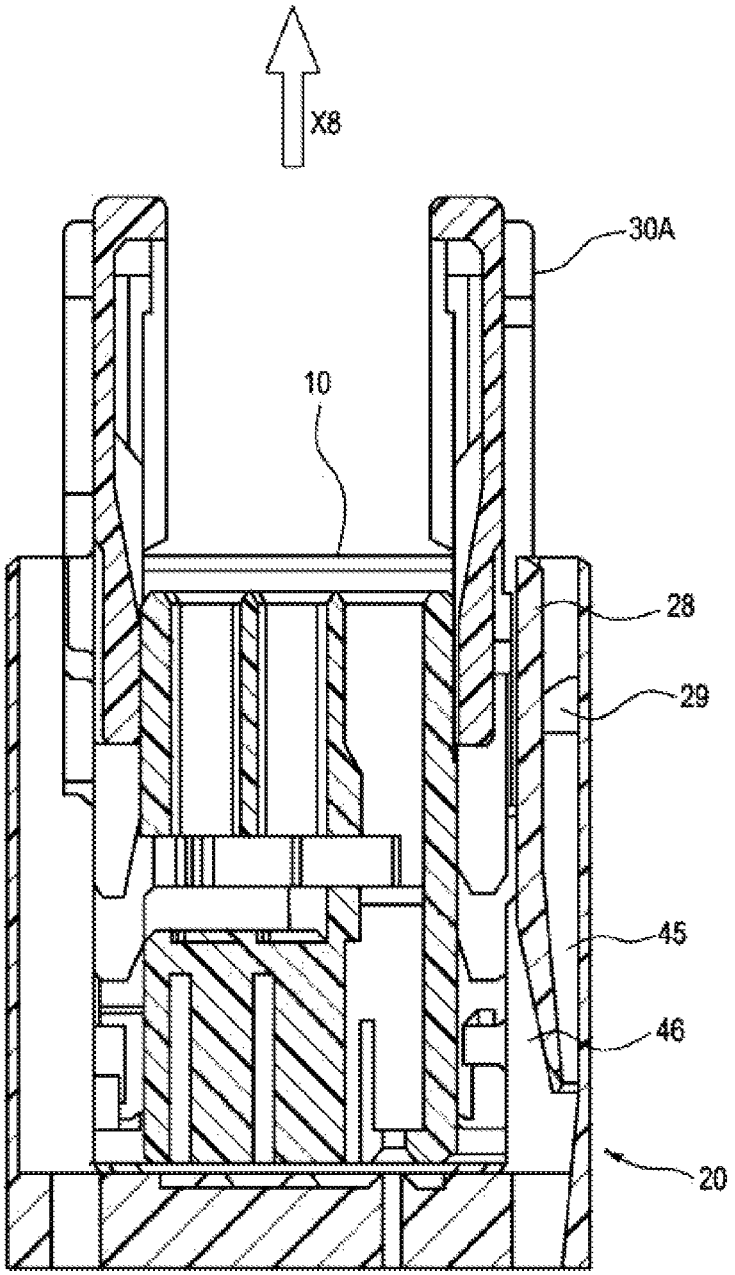
FIG. 21 is a sectional view taken along the line I-I in FIG. 20.
Figure 22:
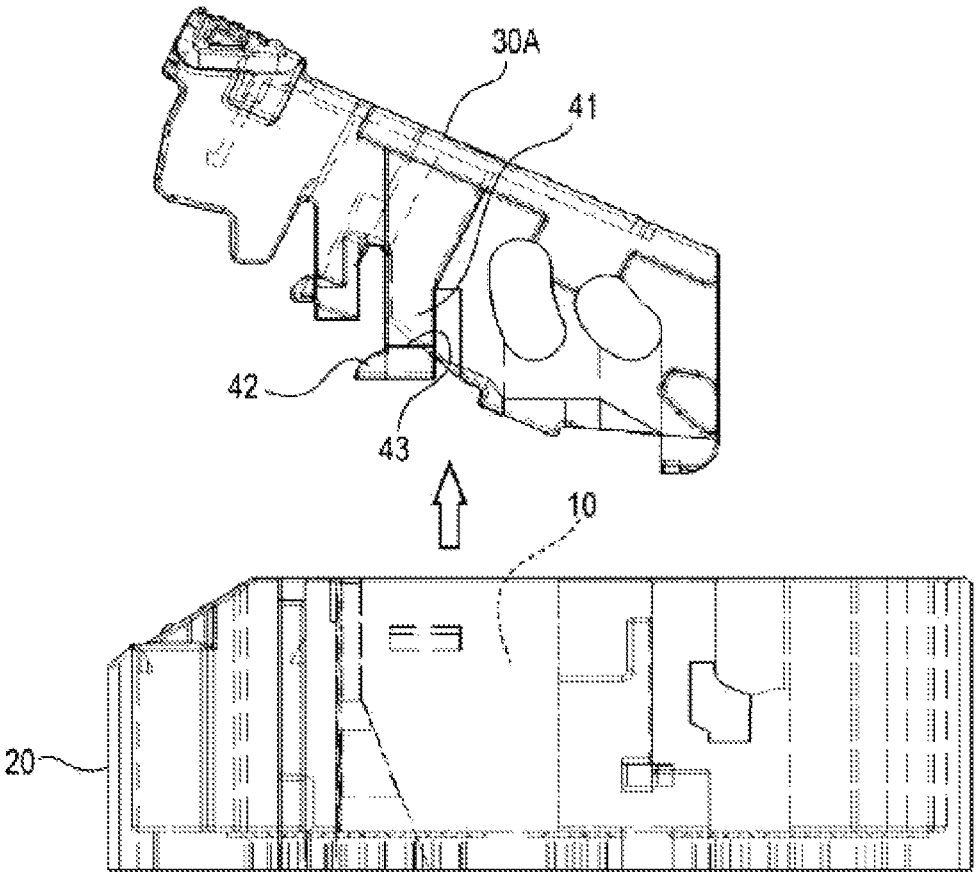
FIG. 22 is a side view showing a state in which the fitting operation lever is disengaged from the connector housings which are fitted together completely as shown in FIG. 20.
Figure 23:
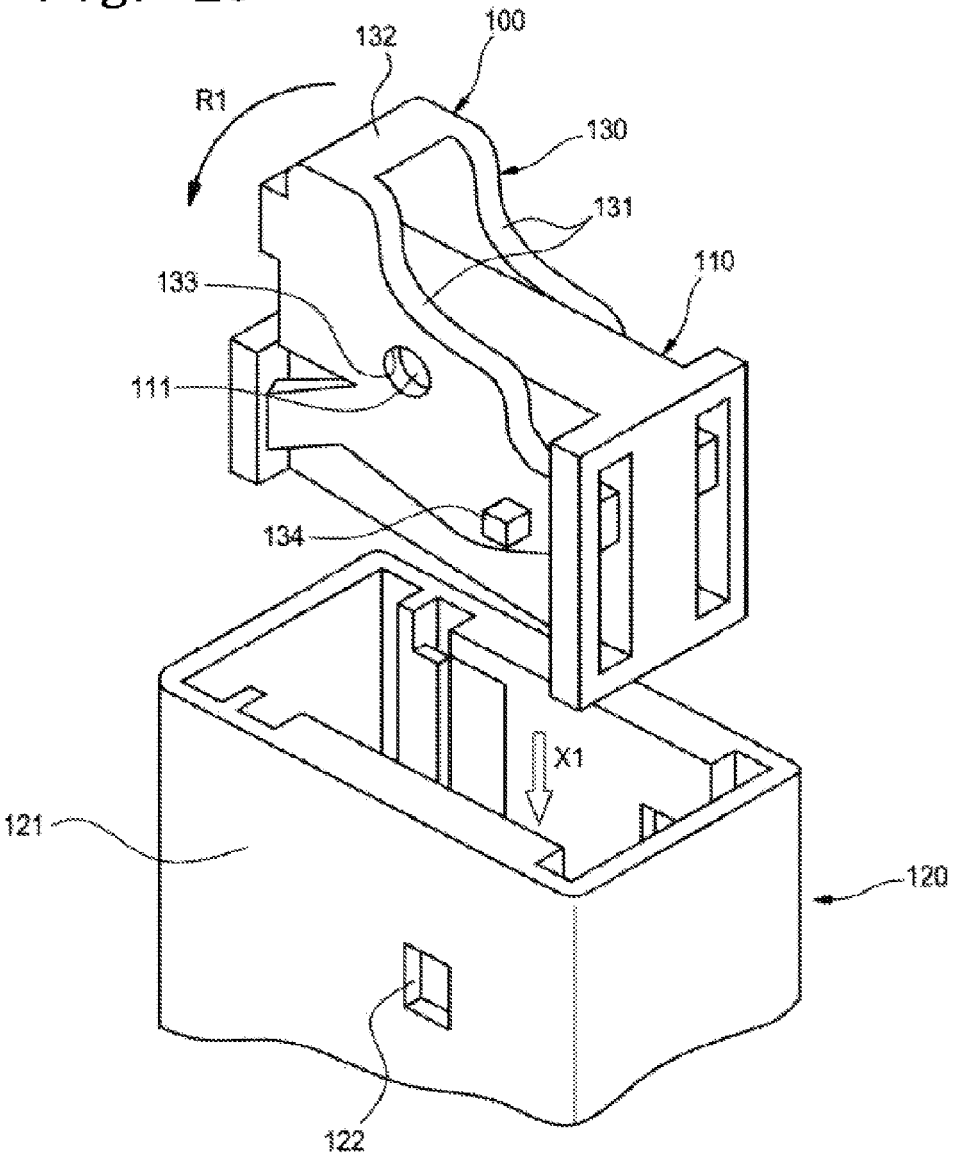
PRIOR ART Fig. 23
FIG. 23 is an exploded perspective view of a conventional lever-type connector.

FIG. 13 is an exploded perspective view of a lever-type connector of a second embodiment. FIG. 14 is a perspective view of a second connector housing shown in FIG. 13 as seen from a direction indicated by an arrow F. FIG. 15 is a side view of a state in which a first connector housing on which a fitting operation lever shown in FIG. 13 is mounted and the second connector housing are disposed so as to be opposite. FIG. 16 is a side view of a state in which the first connector housing and the second connector housing which are shown in FIG. 15 are started to be fitted together where the first connector housing and the second connector housing are aligned with a fitting starting position. FIG. 17 is a side view taken along the line G-G in FIG. 16. FIG. 18 is a side view of a state in which the first connector housing and the second connector housing which are shown in FIG. 16 are fitted together completely for connection by the rotation of the fitting operation lever. FIG. 19 is a sectional view taken along the line H-H in FIG. 18. FIG. 20 is a side view of a state in which the rotation of the fitting operation lever is reversed to thereby return action point projecting portions to projecting portion guiding grooves so as to disengage the fitting operation lever after the connector housings are fitted together completely. FIG. 21 is a sectional view taken along the line I-I in FIG. 20. FIG. 22 is a side view of a state in which the fitting operation lever is disengaged from the connector housings which are fitted together completely as shown in FIG. 20.

A lever-type connector 1A of the second embodiment uses an improved fitting operation lever 30A in place of the fitting operation lever 30 shown in the lever-type connector 1 of the first embodiment. A first connector housing 10 on which the fitting operation lever 30A is mounted rotatably and a second connector housing 20 may be the same as those of the first embodiment, and the description of the configurations described in the first embodiment will be omitted.

The fitting operation lever 30A of the second embodiment is such that an elastic arm 41, a guiding path switching projection 42 and a half-fitting detecting step portion 43 are additionally provided on the fitting operation lever 30 of the first embodiment.

The elastic arm 41 extends from a lever main body 31 in a direction in which the elastic arm 41 is fitted in the second connector housing 20 and functions as a plate spring which can elastically be deformed in a widthwise direction of the connector (a direction indicated by an arrow W1 in FIG. 13).

The guiding path switching projection 42 is formed so as to project from a distal end portion of the elastic arm 41 in a direction which is orthogonal to the fitting direction of the connector housings (a direction indicated by an arrow X6 in FIG. 13). This guiding path switching projection 42 is provided so as to be inserted through a first guiding path 45 and a second guiding path 46 (refer to FIGS. 17, 19, 21) which are defined by a bulkhead portion 28 of the second connector housing 20 shown in FIG. 14.

As shown in FIG. 17, the bulkhead portion 28 which is provided inside an outer cylindrical wall portion 22 of the second connector housing 20 is a single wall member which extends along the fitting direction of the connector housings within the outer cylindrical wall portion 22 and which is curved outwardly at a portion thereof which is situated deeper inside the second connector housing 20. Both surfaces of this bulkhead portion 28 define two guiding paths of the first guiding path 45 and the second guiding path 46.

The first guiding path 45 is a passageway which is held by an outer surface of the bulkhead portion 28 and an outer wall 22*c* of the outer cylindrical wall portion 22. This first guiding path 45 is formed into the passageway which is curved outwards, and the guiding path switching projection 42 is inserted therethrough when the first connector housing 10 and the second connector housing 20 are fitted together. This first guiding path 45 restricts the position of the guiding path switching projection 42 so that the elastic arm 41 is kept deflected outwards when the connector housings are fitted together halfway.

Further, the first guiding path 45 releases the restriction on the position of the guiding path switching projection 42 when the connector housings are fitted together completely and guides the guiding path switching projection 42 to a normal arriving position where no deflection is produced in the elastic arm 41 as indicated by an arrow X7 in FIG. 19 by means of a restoring force of the elastic arm 41.

As shown in FIG. 17, the second guiding path 46 is a passageway which is secured on an inner surface side of the bulkhead portion 28. This second guiding path 46 guides the guiding path switching projection 42 which has moved to the normal arriving position so as to move freely in a direction in which the connector housings are disengaged from each other, as shown in FIG. 19.

Namely, the guiding path switching projection 42 which has moved to the normal arriving position as shown in FIG. 19 can be pulled out of the second connector housing 20 through the second guiding path 46 as indicated by an arrow Y4 in FIG. 19.

The half-fitting detecting step portion 43 is a step which is formed near the guiding path switching projection 42 so as to project towards an outer surface of the elastic arm 41. This half-fitting detecting step portion 43 is brought into engagement with a lower surface of a half-fitting detecting projection 29 which is provided on an inner surface of the outer wall 22*c* of the outer cylindrical wall portion 22 as shown in FIGS. 16 and 17 to thereby restrict the fitting operation lever 30 from moving in a disengaging direction when the connector housings are aligned with a fitting starting position.

In other words, the half-fitting detecting projection 29 which is provided on the inner surface of the outer cylindrical wall portion 22 is brought into abutment with the half-fitting detecting step portion 43 which is provided near the guiding path switching projection 42 on the first guiding path 45 to thereby restrict the fitting operation lever 30 from moving in the disengaging direction when the connector housings are aligned with the fitting starting position.

Next, a method of fitting and connecting together the connector housings of the lever-type connector 1A of the second embodiment and a method of disengaging the fitting operation lever 30A after the connector housings are fitted and connected together will be described based on FIGS. 15 to 22.

When the connector housings are fitted and connected together, as shown in FIG. 15, the first connector housing 10 on which the fitting operation lever 30A is mounted and the second connector housing 20 are disposed to be opposite to each other.

Next, the connector housings which are disposed opposite to each other are aligned with the fitting starting position as shown in FIG. 16. By aligning the connector housings with the fitting starting position, the action point projecting portions 37 of the fitting operation lever 30A arrive at the engagement starting positions P1 on the projecting portion guiding grooves 25 within the outer cylindrical wall portion 22. Additionally, by the locking releasing projections 39*c* of the temporary locking arms 39 of the fitting operation lever 30A passing through the temporary locking releasing raceways 26 of the second connector housing 20, the temporary locked state of the fitting operation lever 30A by the positioning projections 17*a*, 17*b* is released, whereby the fitting operation lever 30A is allowed to rotate around the boss portions 13 as the center of rotation.

Additionally, in such a state that the guiding path switching projection 42 on the elastic arm 41 advances in the first guiding path 45 and the connector housings are aligned with the fitting starting position, as shown in FIG. 17, the half-fitting detecting step portion 43 is brought into engagement with the lower surface of the half-fitting detecting projection 29, whereby the fitting operation lever 30A is prevented from being removed.

Then, when an application point portion 38 of the fitting operation lever 30A is rotated in a direction indicated by an arrow R6 from the state shown in FIG. 16 where the connector housings are aligned with the fitting starting position, the action point projecting portions 37 on the fitting operation lever 30A are brought into engagement with the projection engagement projecting portions 27 thereon of the second connector housing 20 in association with the rotation of the fitting operation lever 30A. When the rotation of the fitting operation lever 30 is completed, as shown in FIG. 18, the connector housings are fitted together completely for connection.

In such a state that the connector housings are fitted together completely for connection, the locking piece 18 of the first connector housing 10 is in engagement with the locking projection 23 of the second connector housing 20, whereby the connection of the first connector housing 10 and the second connector housing 20 is locked.

Further, in such a state that the connector housings are fitted together completely for connection, as shown in FIGS. 18 and 19, the position restriction on the guiding path switching projection 42 by the first guiding path 45 defined by the bulkhead portion 28 is released, and the guiding path switching projection 42 is guided to a normal arriving position where no deflection is produced in the elastic arm 41 and is then allowed to be inserted through the second guiding path 46.

Then, in such a state that the connector housings are fitted together completely for connection, when the fitting operation lever 30A is rotated in a returning direction as indicated by arrow R7 in FIG. 20, as was described in the first embodiment, the action point projecting portions 37 rotate to move in a direction in which the action point projecting portions 37 move away from the projection engagement projecting portions 27 to return into the projecting portion guiding grooves 25. In addition, the guiding path switching projection 42 passes through the second guiding path 46 to move in the disengaging direction.

Then, in the state shown in FIGS. 20 and 21, by pulling the fitting operation lever 30A in a direction indicated by an arrow X8, the fitting operation lever 30A can be disengaged from the first connector housing 10 and the second connector housing 20.

When the lever-type connector 1A according to the second embodiment is used normally, by disengaging the fitting operation lever 30A after the connector housings have been fitted together for connection, the weight of the lever-type connector 1A can be reduced.

According to the lever-type connector 1A of the second embodiment that has been described heretofore, in addition to the function and advantage provided by the first embodiment, the following function and advantage can further be obtained.

Namely, in the lever-type connector 1A of the second embodiment, when the connector housings are fitted together completely in a proper fashion, the guiding path switching projection 42 provided on the fitting operation lever 30A passes through the first guiding path 45 within the second connector housing 20 to arrive at the normal arriving position. The guiding path switching projection 42 in the normal arriving position can move freely in the direction in which the connector housings are disengaged from each other by being guided by the second guiding path 46, and therefore, the fitting operation lever 30 can be disengaged from both the connector housings.

When the connector housings are fitted together halfway, however, the guiding path switching projection 42 provided on the fitting operation lever 30A is positioned halfway down in the first guiding path 45 within the second connector housing 20. When the fitting operation lever 30A is moved in the disengaging direction with the guiding path switching projection 42 positioned halfway down in the first guiding path 45 in the way described above, the half-fitting detecting step portion 43 which is provided near the guiding path switching projection 42 is brought into engagement with the half-fitting detecting projection 29 within the second connector housing 20, whereby the fitting operation lever 30A is restricted from moving in the disengaging direction.

Consequently, in the lever-type connector 1A of the second embodiment, in the event that the fitting operation lever 30A cannot be disengaged from both the connector housings after the fitting operation of the connector housings has been completed, the connector housings are in the midst of being fitted together. Thus, it is possible to determine on the fitting conditions of the connector housings from the disengaging operation of the fitting operation lever 30A, thereby making it possible to prevent the failure to locate a fitting error of the connector housings.

Additionally, in the lever-type connector 1A of the second embodiment, by providing the single bulkhead portion 28, it is possible to define the two guiding paths of the first guiding path 45 and the second guiding path 46. In other words, the first guiding path 45 and the second guiding path 46 can be provided while suppressing the complexity of the construction of the second connector housing 20, whereby it is possible to prevent the complexity of the construction of the second connector housing 20.

The invention is not limited to the embodiments that have been described heretofore and can be modified, improved or the like as required. In addition, the materials, shapes, dimensions, numbers, where to dispose the constituent elements and the like are arbitrary and there is imposed no limitation thereon, provided that the invention can be achieved thereby.

While the invention has been described in detail and by reference to the specific embodiments, it is obvious to those skilled in the art to which the invention belongs that various alterations or modifications can made thereto without departing from the spirit and scope of the invention.

This patent application is based on Japanese Patent Application (No. 2012-025348) filed on Feb. 8, 2012, the contents of which are incorporated herein by reference.

The characteristics of the lever-type connector according to the invention which has been described by reference to the embodiments will be enumerated briefly altogether under [1] to [3] below.

[1] A lever-type connector, including:

a first connector housing (10);

a second connector housing (20) having an outer cylindrical wall portion (22) into which the first connector housing (10) is inserted and configured to be fitted together with the first connector housing (10) for connection; and a fitting operation lever (30) which is rotatably mounted on the first connector housing (10) as a lever member which reduces operation forces to be exerted when the first connector housing (10) and the second connector housing (20) are fitted together and are released from the fitted state, wherein the fitting operation lever (30) includes:

a pair of lever main bodies (31) which are disposed opposite to each other so as to hold a pair of outer surfaces (12*a*) of the first connector housing (10) therebetween;

rotation fulcrum holes (33) which are formed in the lever main bodies (31*a*) which lie to be opposite to the outer surfaces (12*a*) of the first connector housing (10) so as to be brought into rotational engagement with boss portions (13) which are provided individually on the outer surfaces (12*a*) of the first connector housing (10) so as to project therefrom;

boss guiding grooves (34) which are formed on inner surfaces of the lever main bodies) (31) and depressed thereinto so as to enable an engagement or disengagement between the boss portions (13) and the rotation fulcrum holes (33) by allowing the lever main bodies (31) to be placed on or displaced from the first connector housing (10) along a direction in which the connector housings are fitted together;

action point projecting portions (37), which are provided on outer surfaces of the lever main bodies (31) so as to project therefrom as a point of action of a lever, which are configured to be inserted through projecting portion guiding grooves (25) which are formed on inner surfaces of the outer cylindrical wall portion (22) to arrive at an engagement starting position inside the outer cylindrical wall portion (22) at a fitting starting time when the first connector housing (10) and the second connector housing (20) are aligned with a fitting starting position in a state that the rotation fulcrum holes (33) are brought into rotational engagement with the boss portions (13), and which are configured to be brought into engagement with projection engagement projecting portions (27) which are formed adjacent to the projecting portion guiding grooves (25) on the inner surfaces of the outer cylindrical wall portion (22) so as to apply a force acting in the direction in which the connector housings are fitted together to the second connector housing (20) when the action point projecting portions (37) move as a result of the rotation of the fitting operation lever (30) from the engagement starting position; and an application point portion (38) which receives an operation force that is applied to rotate the lever main bodies (31) on the boss portions (13) as a rotational center, wherein the rotation fulcrum holes (33) are formed into an elliptic shape which enables the action point projecting portions (37) to be disengaged from the projection engagement projecting portions (27) inside the outer cylindrical wall portion (22) without applying the force acting in the fitting direction to the second connector housing (20) so as to return to the projecting portion guiding grooves (25) as a result of their contact positions with the boss portions (13) moving when the fitting operation lever (30) is rotated in a returning direction after the connector housings are completely fitted together for connection.

[2] The lever-type connector according to [1] above, wherein the fitting operation lever (30) includes an elastic arm (41) which extends from the lever main bodies (31) along the direction in which the first connector housing (10) is fitted in the second connector housing (20), a guiding path switching projection (42) which is formed to project from a distal end side of the elastic arm (41) in a direction which is orthogonal to the fitting direction, and a half-fitting detecting step portion (43) which is formed near the guiding path switching projection (42), and wherein the second connector housing (20) includes:

a first guiding path (45), which is configured to restrict the guiding path switching projection (42) so as to be positioned outwards to hold the elastic arm (41) in an outwardly deflected state when the connector housings are fitted together halfway, and which is configured to release the restriction on the position of the guiding path switching projection (42) so as to guide the guiding path switching projection (42) to a normal arriving position where there is produced no deflection in the elastic arm (41) by means of a restoring force of the elastic arm (41) when the connector housings are fitted together completely;

a second guiding path (46) which is configured to guide the guiding path switching projection (42) in the normal arriving position so as to move freely in a direction in which the connector housings are disengaged from each other; and a half-fitting detecting projection (29), which is disposed to face the first guiding path (45), and which is configured to be brought into engagement with the half-fitting detecting step portion (43) to restrict the movement of the fitting operation lever (30) in the disengaging direction when the connector housings are positioned in the fitting starting position.

[3] The lever-type connector according to [2] above, wherein both surfaces of a single bulkhead portion (28) which is formed into an outwardly curved shape along the fitting direction within the outer cylindrical wall portion (22) define the first guiding path (45) and the second guiding path (46).

INDUSTRIAL APPLICABILITY

According to the lever-type connector of the invention, after the connector housings are fitted together completely, the fitting operation lever is disengaged from both the connector housings, thereby making it possible to realize a reduction in weight of the lever-type connector when in use.

The fitting operation lever which is so removed can be used to execute a fitting operation on another lever-type connector. This enables a normal parts set to be made up of only a first connector housing and a second connector housing excluding a fitting operation lever, thereby making it possible to realize a reduction in cost by reducing the number of parts involved in the parts set.

DESCRIPTION OF REFERENCE NUMERALS

1, 1A lever-type connector
10 first connector housing
12 terminal accommodating portion
12*a* outer surfaces
13 boss portion
14 lever placement restricting boss portion
20 second connector housing
22 outer cylindrical wall portion (hood portion)
25 projecting portion guiding groove
27 projection engagement projecting portion
28 bulkhead portion
29 half-fitting detecting projection
30, 30A fitting operation lever
31 lever main body
33 rotation fulcrum hole
34 boss guiding groove
35 placement restricting groove
36 lever placement restricting fitting hole
37 action point projecting portion
38 application point portion
39 temporary locking arm
41 elastic arm
42 guiding path switching projection
43 half-fitting detecting step portion

The invention claimed is:

1. A lever-type connector, comprising:

a first connector housing;

a second connector housing having an outer cylindrical wall portion into which the first connector housing is inserted and configured to be fitted together with the first connector housing for connection; and a fitting operation lever which is rotatably mounted on the first connector housing as a lever member which reduces operation forces to be exerted when the first connector housing and the second connector housing are fitted together in a fitted state and are released from the fitted state;

wherein the fitting operation lever includes:

a pair of lever main bodies which are disposed opposite to each other so as to hold a pair of outer surfaces of the first connector housing therebetween;

rotation fulcrum holes which are formed in the lever main bodies which are opposite to the outer surfaces of the first connector housing so as to be brought into rotational engagement with boss portions which are provided individually on the outer surfaces of the first connector housing so as to project therefrom;

boss guiding grooves which are formed on inner surfaces of the lever main bodies and depressed thereinto so as to enable an engagement or disengagement between the boss portions and the rotation fulcrum holes by allowing the lever main bodies to be placed on or displaced from the first connector housing along a fitting direction in which the first and second connector housings are fitted together;

action point projecting portions, which are provided on outer surfaces of the lever main bodies so as to project therefrom as a point of action of a lever, and which are configured to be inserted through projecting portion guiding grooves formed on inner surfaces of the outer cylindrical wall portion to arrive at an engagement starting position inside the outer cylindrical wall portion at a fitting starting time when the first connector housing and the second connector housing are aligned with a fitting starting position in a state that the rotation fulcrum holes are brought into rotational engagement with the boss portions, the action point projecting portions being further configured to be brought into engagement with projection engagement projecting portions formed adjacent to the projecting portion guiding grooves on the inner surfaces of the outer cylindrical wall portion so as to apply a force acting in the fitting direction in which the first and second connector housings are fitted together to the second connector housing when the action point projecting portions move as a result of the rotation of the fitting operation lever from the engagement starting position; and an application point portion which receives an operation force that is applied to rotate the lever main bodies on the boss portions as a rotational center, wherein the rotation fulcrum holes are formed into an elliptic shape which enables the action point projecting portions to be disengaged from the projection engagement projecting portions inside the outer cylindrical wall portion without applying the force acting in the fitting direction to the second connector housing so as to return to the projecting portion guiding grooves as a result of their contact positions with the boss portions moving when the fitting operation lever is rotated in a returning direction after the connector housings are fitted together for connection.

2. The lever-type connector according to the claim 1, wherein the fitting operation lever includes an elastic arm which extends from the lever main bodies along the direction in which the first connector housing is fitted in the second connector housing, a guiding path switching projection which is formed to project from a distal end side of the elastic arm in a direction orthogonal to the fitting direction, and a half-fitting detecting step portion which is formed near the guiding path switching projection, and wherein the second connector housing includes:

a first guiding path, which is configured to restrict the guiding path switching projection so as to be positioned outwards to hold the elastic arm in an outwardly deflected state when the connector housings are fitted together halfway, and which is configured to release the restriction on the position of the guiding path switching projection so as to guide the guiding path switching projection to a normal arriving position where there is produced no deflection in the elastic arm by a restoring force of the elastic arm when the connector housings are fitted together completely;

a second guiding path which is configured to guide the guiding path switching projection in the normal arriving position so as to move freely in a direction in which the connector housings are disengaged from each other; and a half-fitting detecting projection, which is disposed to face the first guiding path, and which is configured to be brought into engagement with the half-fitting detecting step portion to restrict the movement of the fitting operation lever in a disengaging direction when the connector housings are positioned in the fitting starting position.

3. The lever-type connector according to the claim 2, wherein both surfaces of a single bulkhead portion which is formed into an outwardly curved shape along the fitting direction within the outer cylindrical wall portion define the first guiding path and the second guiding path.

* * * * *